US011670326B1

(12) United States Patent
Nakagawa

(10) Patent No.: US 11,670,326 B1
(45) Date of Patent: Jun. 6, 2023

(54) NOISE DETECTION AND SUPPRESSION

(71) Applicant: Amazon Technologies, Inc., Seattle, WA (US)

(72) Inventor: Carlos Renato Nakagawa, San Jose, CA (US)

(73) Assignee: Amazon Technologies, Inc., Seattle, WA (US)

( * ) Notice: Subject to any disclaimer, the term of this patent is extended or adjusted under 35 U.S.C. 154(b) by 49 days.

(21) Appl. No.: 17/361,378

(22) Filed: Jun. 29, 2021

(51) Int. Cl.

| | |
|---|---|
| ***G10L 25/78*** | (2013.01) |
| ***G10L 21/0216*** | (2013.01) |
| ***H04R 5/04*** | (2006.01) |
| ***H04R 3/00*** | (2006.01) |
| ***H04R 3/04*** | (2006.01) |

(52) U.S. Cl.
CPC ..... *G10L 25/78* (2013.01); *G10L 21/0216* (2013.01); *H04R 3/005* (2013.01); *H04R 3/04* (2013.01); *H04R 5/04* (2013.01)

(58) Field of Classification Search
CPC . G10L 25/78; G10L 21/0216; G10L 21/0264; G10L 2021/02165; H04R 3/005; H04R 3/04; H04R 5/04; H04R 2410/07
See application file for complete search history.

(56) References Cited

U.S. PATENT DOCUMENTS

2010/0150375 A1* 6/2010 Buck ..... G10L 25/78 381/94.1
2012/0140946 A1* 6/2012 Yen ..... H04R 3/005 381/92

FOREIGN PATENT DOCUMENTS

CN 109215677 A * 1/2019 ..... G10L 21/0264

* cited by examiner

*Primary Examiner* — Yogeshkumar Patel
(74) *Attorney, Agent, or Firm* — Pierce Atwood LLP

(57) ABSTRACT

Techniques for improving microphone noise detection and suppression are provided. A method for detecting wind noise corresponding to microphone signals may include determining a phase of a complex coherence of the microphone signals. The phase may be used to determine a presence of wind near the microphones. A derivative of the phase may be used to determine a presence of speech near the microphones. Further, a method for suppressing noise caused by the wind may include determining a gain based on a cross power spectrum of the microphone signals and applying the gain to the microphone signals. The method for suppressing the noise may also include attenuating the microphone signals using a post filter. Based on detection of the wind, microphones which are more exposed to the wind may not be used to process the speech whereas microphones less exposed to the wind may be used to process the speech.

18 Claims, 10 Drawing Sheets

NOISE DETECTION AND SUPPRESSION

BACKGROUND

With the advancement of technology, the use and popularity of electronic devices has increased considerably. Electronic devices are commonly used to capture and process audio data.

BRIEF DESCRIPTION OF DRAWINGS

For a more complete understanding of the present disclosure, reference is now made to the following description taken in conjunction with the accompanying drawings.

DETAILED DESCRIPTION

Electronic devices may be used to capture audio and process audio data. The audio data may be used for voice commands and/or sent to a remote device as part of a communication session. To process voice commands, the device may attempt to detect speech and sources of noise, such as ambient noise in an environment around the device. Further, the device may perform noise suppression to remove, from the audio data, any undesired noise that may distract from the desired audio the device (for example, user speech) is attempting to capture. An example of ambient noise may be noise caused by wind.

Wind that causes noise may be naturally occurring wind (e.g., outdoors) that may flow towards or cause air to reach near one or more microphones of a device, such as a smartphone or other speech-enabled device. The wind may also be caused by mechanical devices or other devices such as fans, air conditioners, etc. For example, the wind may be caused by a fan system (e.g., a fan associated with heating/air conditioning) of a vehicle (e.g., a car, boat, etc.). The fan system may cause wind by causing air to blow through a vent of the vehicle. A device (e.g., a speech enabled device) with one or more microphones may be vent-mountable and may be positioned in front of the vent of the vehicle. Thus, as the fan blows air through the vent of the vehicle, wind may be generated and may cause noise (e.g., wind noise) to be received by the one or more microphone.

Figure 1:
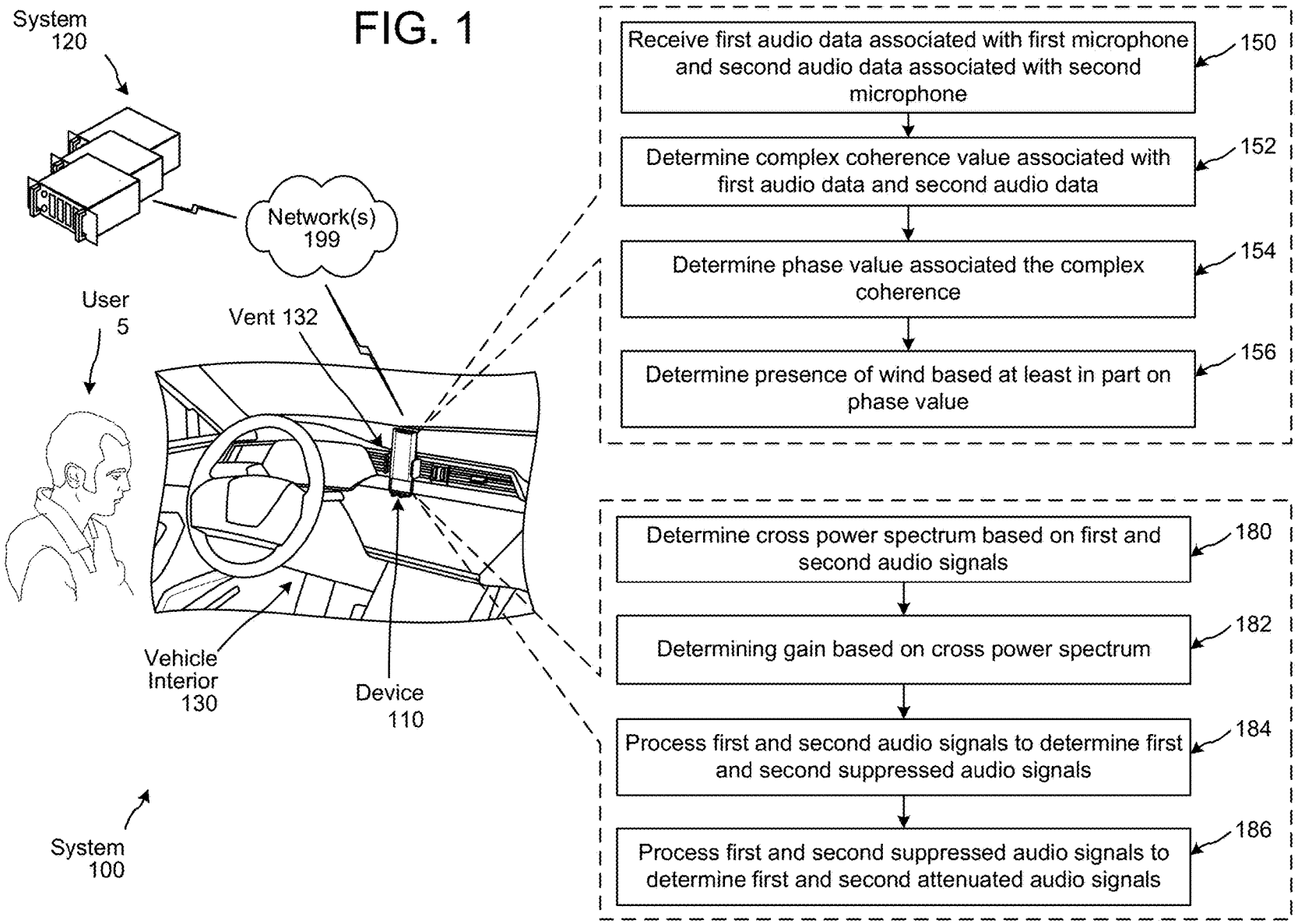
FIG. 1 is a conceptual diagram illustrating a system for noise detection and suppression, according to embodiments of the present disclosure.
Figure 2:
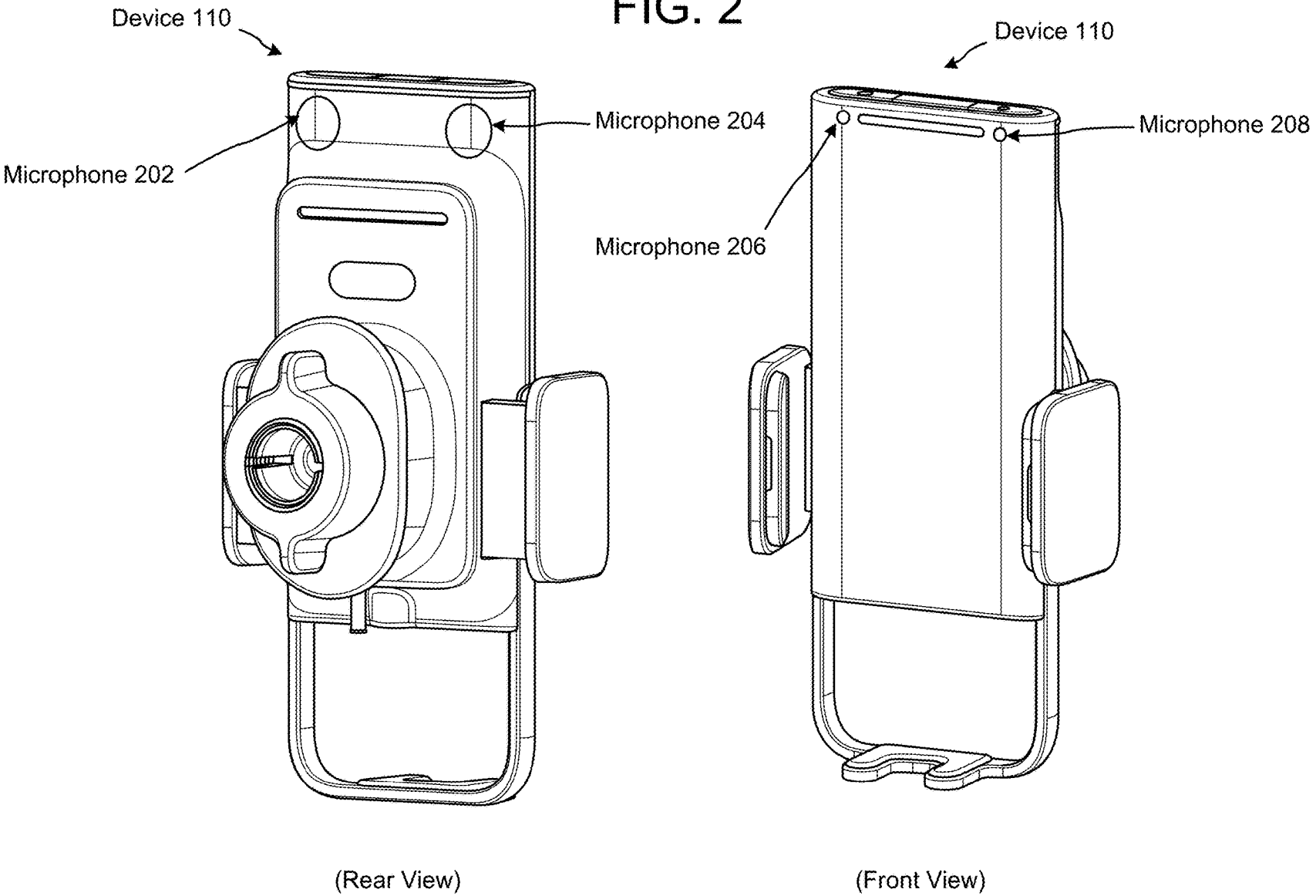
FIG. 2 is a diagram illustrating rear and front views of a mountable device according to embodiments of the present disclosure.

An example of such a device is device 110 shown in FIG. 1 as being mounted in a vehicle interior 130. A further diagram detailing aspects of the device 110 is shown in FIG. 2. Referring now to FIG. 2, a diagram illustrating rear and front views of a mountable device according to embodiments of the present disclosure is shown. The device 110 may be mountable to a vent of a vehicle (e.g., vent-mountable) and may include four microphones. As shown in the rear view of the device 110, microphones 202 and 204 (e.g., rear-facing microphones) may be included as part of (or mounted to) the device 110 and may be rear-facing relative to the device 110. In other words, the microphones 202 and 204 may face the vent of the vehicle when mounted to (or proximate to) the vent. Further, as shown in the rear view of the device 110, microphones 206 and 208 (e.g., rear-facing microphones) may be mounted to the device 110 and may be front-facing relative to the device 110. In other words, the microphones 206 and 208 may face a direction opposite of the vent of the vehicle when mounted to the vent. For example, the microphones 206 and 208 may face an interior of a vehicle. However, the present disclosure is not limited thereto and the device 110 may include additional microphones or other components without departing from the disclosure. Wind may be generated as the fan blows air through the vent of the vehicle and may cause audio corresponding to the wind noise to be received by one or more of the microphones 202, 204, 206, and 208, and particularly by the rear-facing microphones 202 and 204.

Wind noise may be caused by air turbulence close to the one or more microphones. For example, air may cling to a boundary layer of the one or more microphones. The boundary layer may be a layer of fluid or gas close to a surface where a resistance to flow (e.g., viscosity) is significant. The noise signals corresponding to the wind noise may approach the microphones (e.g., the microphones 202 and 204) and be received by the microphones. The noise signals may be uncorrelated.

Audio signals (e.g., noise signals) resulting from wind may be received at two different microphones and may have an inconsistent phase relationship. For example, the noise signals received at the two different microphones may have dissimilar phase differences (e.g., the signal waves may have inconsistently drifting phases). Signals that have dissimilar phase differences may be referred to as incoherent signals. Noise signals (received at two different microphones) resulting from wind may tend to be incoherent signals. Audio signals (e.g., speech signals) resulting from speech may be received at two different microphones and may have a more consistent phase relationship. For example, the speech signals received at the two different microphones may have the same or similar phase differences (e.g., the signal waves may shift by the same or similar amounts). Signals that have the same or similar phase differences may be referred to as coherent signals. Signals (received at two different microphones) resulting from speech may tend to be coherent signals. The higher the coherency is between the two signals, the more the spectral content of one signal can indicate the spectral content of the other signal.

Wind noise detection processes or algorithms may typically compare samples of audio signals from two microphones. Such processes or algorithms may assume that large phase differences between the microphones indicate a presence of wind noise (e.g., slow-moving turbulence) and that small phase differences indicate an absence of wind noise. These processes or algorithms may overlook some situations where larger phase differences may be caused by unmatched microphones, acoustic reflections, and/or a phase shift caused by microphone spacing. It may be desirable for wind noise detection processes or algorithms to differentiate between noise caused by wind and noise caused by differences between the microphones as a failure to account for these differences may cause other sounds (not caused by wind) to be falsely detected as wind noise. This may lead to overuse of wind noise suppression processes or algorithms which may lead to unintended consequences (e.g., less effective speech detection) when wind noise is not present.

The techniques and features described by the present disclosure may facilitate assessment of the presence of wind noise. Further, the techniques and features described by the present disclosure may facilitate an estimation of the presence of wind noise and speech in part by obtaining power spectral densities (PSD) for the wind noise and speech. Additionally, the techniques features described by the present disclosure may facilitate reducing and/or suppressing wind noise.

Referring now again to FIG. 1, a system for performing noise detection and suppression according to embodiments of the present disclosure is shown. As illustrated in FIG. 2, the device 110 (shown in vehicle interior 130 mounted to vent 132) may include rear-facing microphones 202 and 204 and front-facing microphones 206 and 208 (not shown in FIG. 1). The user 5 may speak and audio corresponding to the speech of user 5 may be received by the microphones 202, 204, 206, and 208. Further, air may blow through the vent 132 and may cause audio corresponding to wind noise caused by the air to be received by one or more of the microphones 202, 204, 206, and 208, and particularly by the rear-facing microphones 202 and 204.

The wind noise may interfere with the detection and/or processing of the speech by the device 110 and/or the system 120 (e.g., via the network(s) 199). The device 110 may perform various operations to account for the wind noise in order to more accurately detect and/or process the speech (e.g., either locally by the device 110, remotely by the system 120, and/or a combination of local and remote processing). For example, the device 110 may perform operations to estimate wind presence and/or to estimate speech presence. Further, as will be discussed in more detail below, the device 110 may perform operations to suppress noise caused by the wind.

Figure 3:
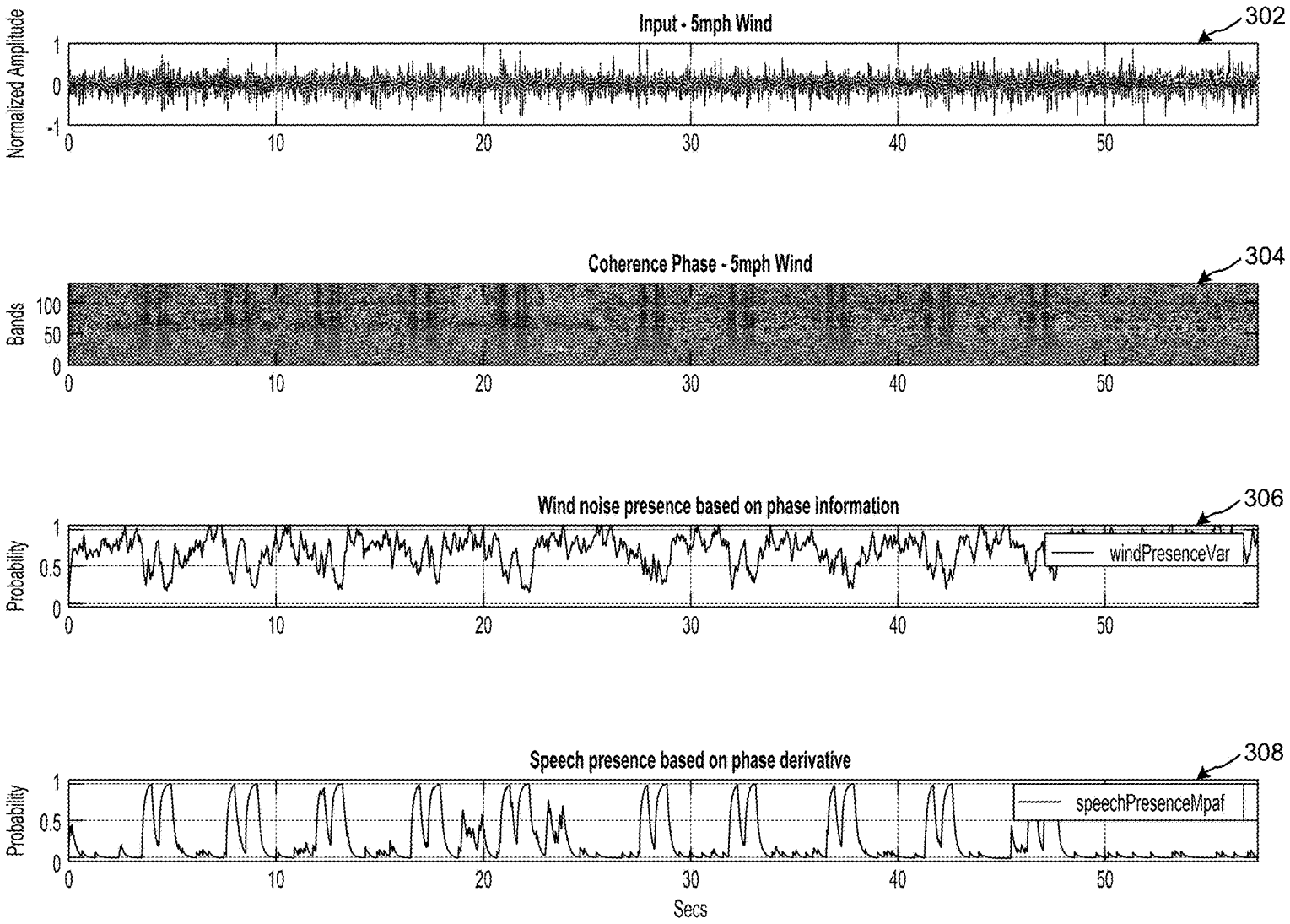
FIG. 3 shows example plots illustrating noise and speech detection according to embodiments of the present disclosure.
Figure 6:
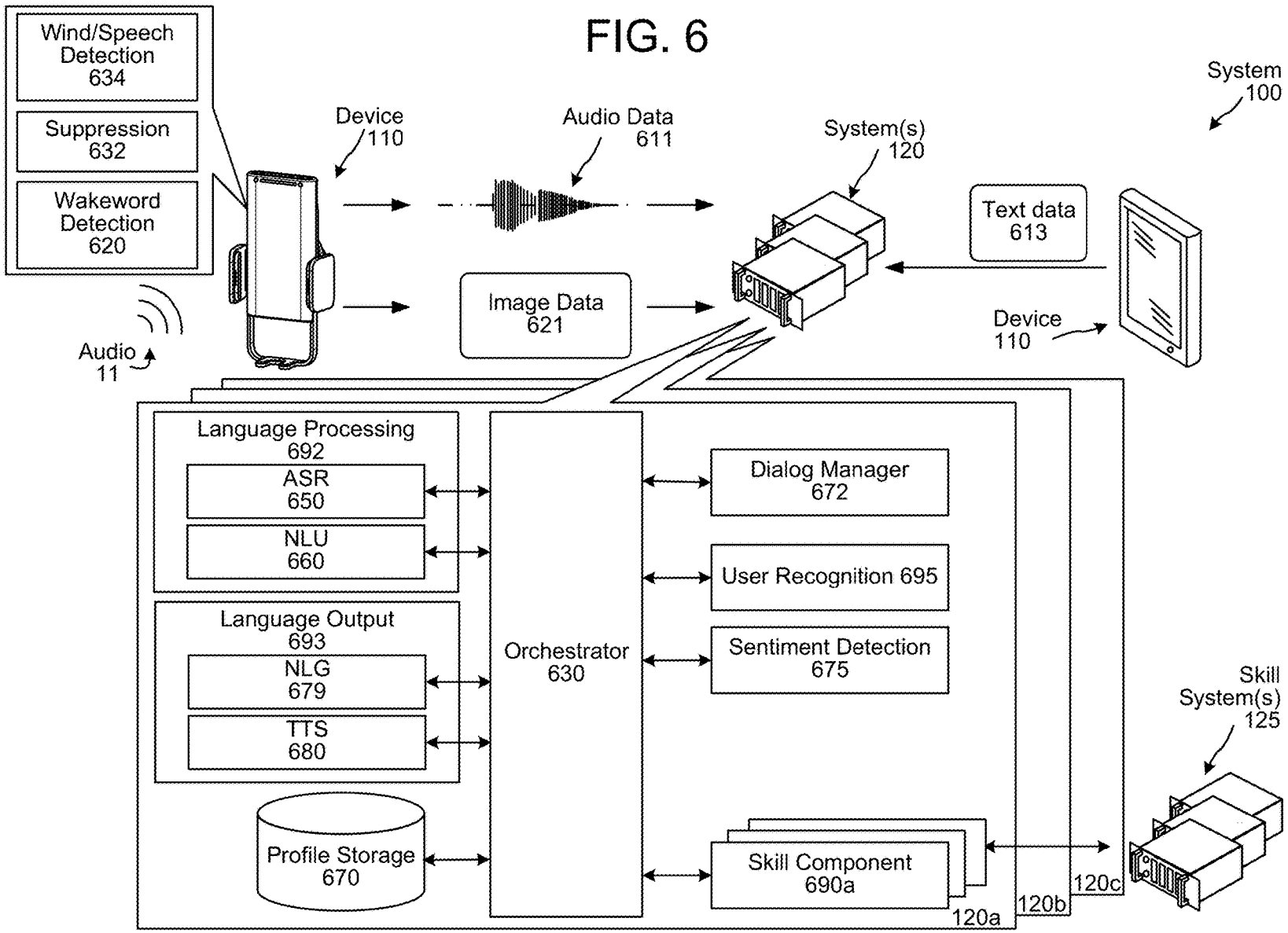
FIG. 6 is a conceptual diagram of components of the system, according to embodiments of the present disclosure.

The operations to estimate the wind presence and the speech presence may include determining a phase of a complex coherence of audio signals received by two microphones (e.g., by the rear-facing microphones 202 and 204) and as explained in further detail in reference to FIGS. 1 and 3. The audio signals may correspond to the wind noise and the speech. The microphones 202 and 204 may capture audio associated with the wind noise and the speech and create corresponding audio data. A wind/speech detection component (e.g., the wind/speech detection component 634 as shown in FIG. 6) of the device 110 and/or the system 120 may receive and process the audio data.

For example, the microphone 202 may create a first audio signal corresponding to the audio received by the microphone 202 and the microphone 204 may create a second audio signal corresponding to the audio received by the microphone 204. Further, the device 110 may create first audio data based on the first audio signal and second audio data based on the second audio signal. The wind/speech detection component 634 may receive (150) the first audio data associated with the microphone 202 and the second audio data associated with the microphone 204. As described above, the first audio data may correspond to audio received by the microphone 202 and the second audio data may correspond to audio received by the microphone 204.

Further, the wind/speech detection component 634 may determine (152) a complex coherence associated with the first audio data and the second audio data. As described above, a first audio signal may correspond to the first audio data and a second audio signal may correspond to the second audio data. The complex coherence F for a particular (k, ω) may be defined as:

$$\Gamma(k,\omega)=\frac{\Phi_{X_1X_2}(k,\omega)}{\sqrt{\Phi X_1,X_1(k,\omega)\Phi X_2,X_2(k,\omega)}} \tag{1}$$

where k represents a time frame number, ω represents a frequency index, $X_1$ represents the audio data from microphone 1 (e.g., the microphone 202) and $X_2$ represents the audio data from microphone 2 (e.g., the microphone 204). The complex coherence (e.g., as represented in equation (1)) may include complex values and may be different than a magnitude-squared coherence (MSC) which may be determined by squaring a magnitude of equation (1) and may include real values but not complex values. Importantly, while the MSC may lack phase information, the complex coherence may retain phase information and may thus be used to determine wind and speech presence based on phase related calculations and/or analysis as described herein.

For real-time applications, power spectral densities may be determined via smoothed periodograms (e.g., an estimate of spectral density of a signal) as:

$$\Phi_{Xi,Xj}(k,\omega)=\alpha\Phi_{Xi,Xj}(k-1,\omega)+(1-\alpha)X_i(k,\omega)X_j^*(k,\omega) \tag{2}$$

where α is a time constant. If, as in the present example, the phase of the complex coherence is of interest, then an estimation $\Phi_{X_1X_2}$ (k, ω) of a cross term may be used. There may be a trade-off, with respect to the time constant α, between wind presence estimation accuracy and adapting to changing coherence properties, in part because wind may be highly non-stationary.

A phase of a wind signal may be almost uniformly distributed in an interval [−π, π]. It follows that a phase of the complex coherence function may be uniformly distributed in an interval [−π, π]. Thus, monitoring the phase of the complex coherence may facilitate estimation and/or detection of wind presence (WP) and the wind/speech detection component 634 may determine (154) a phase associated with the complex coherence (e.g., of the first audio signal and the second audio signal). A normalized measure of the wind presence estimation may be determined as:

$$wp(k)=\frac{3}{\pi^2}\sum_{\omega_1}^{\omega_2}\frac{\phi(k,\omega)^2}{\omega_2-\omega_1} \tag{3}$$

where $\pi^2/3$ is a variance of a uniform distribution in the interval [−π, π], as may be in the case of wind noise, and where ϕ(k, ω) is the phase of the complex coherence for a particular audio sample k and frequency co. Thus, a distribution of the phase associated with the complex coherence may be determined (e.g., at the interval [−π, π]) and determining a presence of wind may be based on the distribution.

Lower frequencies may be of greater interest for $\omega_1$ and $\omega_2$ as wind noise may occur at lower frequencies. A wind presence detection value (WP) may also be smoothed over time to be tuned for optimization of the trade-off between the wind presence estimation accuracy and adapting to changing coherence properties. In this way, the wind/speech detection component 634 may determine (154) the presence of wind associated with the audio (e.g., first audio) corresponding to the first audio signal and the audio (e.g., second audio) corresponding to the second audio signal based on the phase associated with the complex coherence. A WP value closer to one may indicate the presence of wind while a WP value closer to zero may indicate the lack of wind. Thus, the WP value may indicate a level of confidence that wind is present and may be monitored to detect wind presence. For example, as wind may impact lower frequencies (e.g., 1-5 kilohertz), those frequencies may be monitored for WP values closer to one to determine wind presence.

In some embodiments, speech presence (SP) may be estimated and/or detected by, for example, the wind/speech detection component 634 shown in FIG. 6. Determining the presence of speech may be based on a derivative of the phase associated with the complex coherence. For example, speech presence may be determined based on a first derivative of the phase of the complex coherence as described above (e.g., $\phi(k, \omega)$). When speech is present, the speech received at the first microphone (e.g., 202) may be a delayed version of the speech received at the second microphone (e.g., 204) or the speech received at the second microphone (e.g., 204) may be a delayed version of the speech received at the first microphone (e.g., 202) without respect to a magnitude of the speech. Thus, a first derivative of the phase of the complex coherence over time may close to zero when speech is present. The first derivative may be approximated by a phase difference:

$$\Delta\phi(k,\omega)=\phi(k,\omega)-\phi(k-1,\omega) \tag{4}$$

Because complex values may include imaginary and real values, an arctangent function may be used to obtain an angle of interest. Additionally, because differences between two angles at two time frames may be analyzed, phase wrapping may become an issue. Given the range of the arctangent function from $-\pi$ to $\pi$, an angle may rotate continually, for example, around a circle and wraparound from $-\pi$ to $\pi$, and it may not be possible to determine how many wraparounds have occurred in calculating the two angles. To avoid potential phase wrapping issues (e.g., with the arctangent function) the following equation may be used:

$$\bar{\Gamma}(k, \omega) = \frac{\Gamma(k, \omega)}{|\Gamma(k, \omega)|} \tag{5}$$

Equation (5) may be used to determine the phase difference before determining the two angles at different time frames (in some implementations, magnitude component and/or normalization terms may be ignored) by allowing determination of a rotation vector. The rotation vector (which is used below) may be determined as:

$$\bar{\Gamma}_{rot}(k,\omega)=\bar{\Gamma}(k,\omega)\bar{\Gamma}^*(k-1,\omega) \tag{6}$$

Equation (6) may be analogous to the phase difference between the two time frames, but phase difference may then be determined by applying one arctangent function, for example by the equation:

$$\Delta\phi(k, \omega) = \tan^{-1}\frac{\mathrm{Re}\{\bar{\Gamma}_{rot}(k, \omega)\}}{\mathrm{Im}\{\bar{\Gamma}_{rot}(k, \omega)\}} \tag{7}$$

The speech presence estimation may be determined as:

$$s(k) = \sum_{\omega_3}^{\omega_4} \frac{\Delta\phi(k, \omega)^2}{\omega_4 - \omega_3} \tag{8}$$

$$sp(k) = \begin{cases} 1, & \text{if } s(k) < \delta \\ 0, & \text{otherwise} \end{cases} \tag{9}$$

where $\Delta$ may be a tunable threshold close to zero and $\omega_3$ and $\omega_4$ may be frequencies in the speech range and may not overlap with lower frequencies for $\omega_1$ and $\omega_2$ which may be in the wind range. A speech presence (SP) value closer to one may indicate the presence of speech while a SP value closer to zero may indicate the lack of speech. Thus, the SP value may indicate a level of confidence that speech is present and may be monitored to detect speech presence. For example, as speech may impact lower frequencies (e.g., greater than 5 kilohertz), those frequencies may be monitored for SP values closer to one to determine speech presence.

Referring now to FIG. 3 example plots illustrating noise and speech detection according to embodiments of the present disclosure are shown. The plots may illustrate simulation results for estimating and/or detecting wind presence and/or speech presence based one or more of the equations (1)-(9) shown above and example audio data corresponding to a five mile per hour wind flowing to the microphones. The simulation results may also be based on an algorithm simulator. One or more detector parameters may be tuned to create the plots including, but not limited to: a bin parameter, a frequency smoothing parameter, a bin smoothing weight, a time smoothing parameter, a coherence time constant, MSC time constants, WP time constants, SP time constants, SP bin parameters, an SP detect parameter, and/or channel indices.

A plot 302 may show a normalized amplitude of input signals for the microphones 202 and 204. Further, a plot 304 may show a phase of a complex coherence for a range or interval $[-\pi, \pi]$ corresponding to the input signals. Moreover, a plot 306 may show WP estimation values, where values closer to one may indicate a higher chance of wind presence and values closer to zero may indicate a lower chance of wind presence corresponding to the input signals. Furthermore, a plot 308 may show SP estimation values, where values closer to 1 may indicate a higher chance of speech presence and values closer to zero may indicate a lower chance of speech presence corresponding to the input signals. Wind may be uniformly and/or randomly distributed across frequencies but speech may correspond to a more predictable relationship between time and frequency, may be more uniform around certain frequencies, and may be more coherent. These principles may be illustrated in FIG. 3, as the band associated with the phase of the complex coherence increases (e.g., as in plot 304), the probability of detecting wind may decrease (e.g., WP value moves towards zero as shown in plot 306) and the probability of detecting speech may increase (e.g., SP value moves towards one as shown in plot (308).

Figure 4:
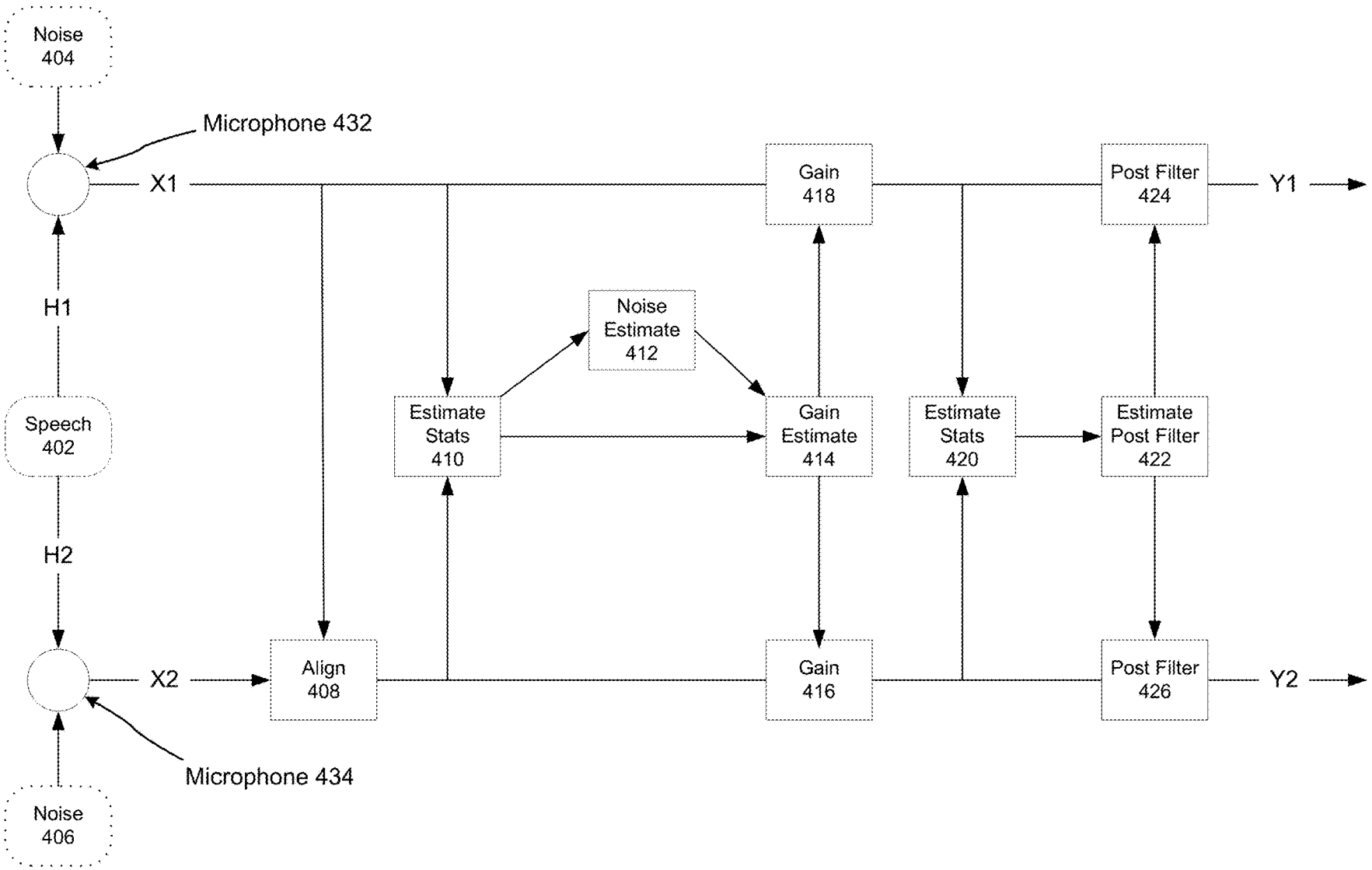
FIG. 4 is a block diagram illustrating example operations according to embodiments of the present disclosure.

Referring now to FIG. 4, a block diagram illustrating example operations for noise suppression according to embodiments of the present disclosure is shown. In some embodiments, the operations for noise suppression may be performed by a suppression component 632 of the device 110 and/or system 120. The suppression component 632 may implement the operations described for one or more of the blocks in FIG. 4. The noise suppression operations may be performed for incoherent noise reduction, such as reduction in noise caused by wind (as wind noise is incoherent) or road-based noise (e.g., from cars or trucks). This is because wind-based audio signals may be incoherent at different microphones and speech-based audio signals may be coherent at different microphones. Thus, the noise suppression component 632 may suppress incoherent audio signals (e.g., associated with wind) of the first and second audio signals and maintain coherent audio signals (e.g., associated with speech) of the first and second audio signals. Other noise that may not be caused by wind may be coherent, and may be suppressed by other components. For example, diffuse noise at higher frequencies may be suppressed by other components. In some embodiments, the techniques and features for wind presence detection/estimation and speech presence detection/estimation described above may be used to inform the operations for noise suppression described below.

As shown in FIG. 4, a speech signal 402 (e.g., S(k, ω)) may be received by a microphone 432 and a microphone 434 (which may, for example, be microphones 202, 204, 206, and/or 208) with attenuation H1 (e.g., $H_1(k, \omega)$) and H2 (e.g., $H_2(k, \omega)$) respectively.

Figure 10:
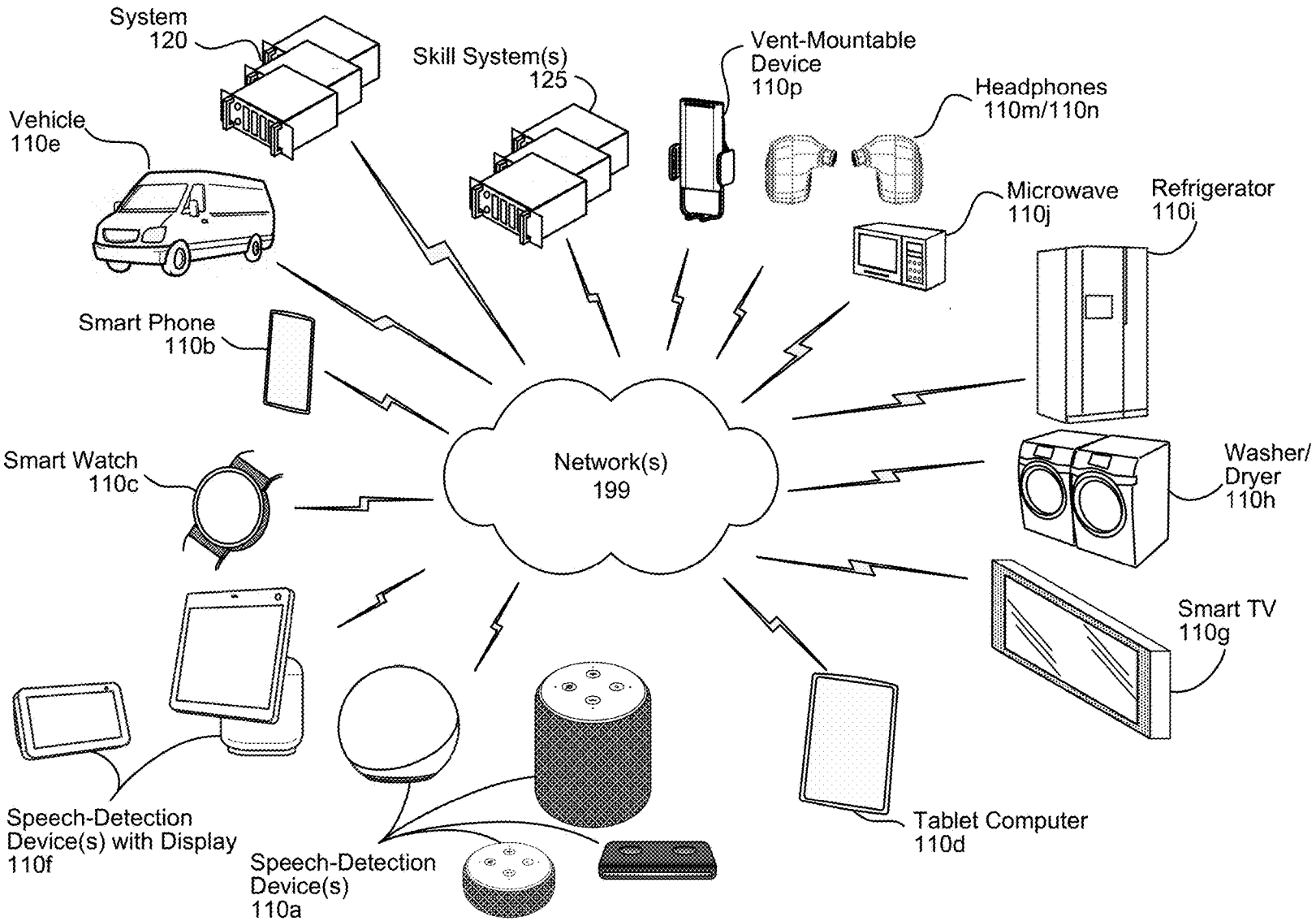
FIG. 10 illustrates an example of a computer network for use with the overall system, according to embodiments of the present disclosure.

In some embodiments, the microphones 432 and 434 may be similar to the microphones 202 and 204 (or 206/208), respectively, described above. However, in some embodiments, the microphones 432 and 434 may not be similar to the microphones 202 and 204 (or 206/208) or may not be mounted to a vent-mountable device, and instead may be implemented with a variety of devices, including but not limited to the devices 110*a*-110*p* as shown in FIG. 10.

A first noise signal 404 (e.g., $N_1(k, \omega)$) may be received by the microphone 432 and a second noise signal 406 (e.g., $N_2(k, \omega)$) may be received by the microphone 434. The noise signals may correspond to wind. The speech signal 402 and the noise signals 404 and 406 may cause the microphones 432 and 434 to generate first and second audio signals X1 (e.g., $X_1(k, \omega)$) and X2 (e.g., $X_2(k, \omega)$) (e.g., microphone signals). Given that, the microphone signals may be represented as $X_1(k, \omega)$ and $X_2(k, \omega)$, the speech signal may be represented as S(k, ω), the attenuation may be represented as $H_1(k, \omega)$ and $H_2(k, \omega)$, and the noise signals may be represented as $N_1(k, \omega)$ and $N_2(k, \omega)$, the microphone signals may $X_1(k, \omega)$ and $X_2(k, \omega)$: may be described by the following equations:

$$X_1(k,\omega)=S(k,\omega)\cdot H_1(k,\omega)+N_1(k,\omega) \tag{10}$$

$$X_2(k,\omega)=S(k,\omega)\cdot H_2(k,\omega)+N_2(k,\omega) \tag{11}$$

It may be assumed that almost the same attenuation of the speech is experienced by the microphone 432 and the microphone 434. Thus, the attenuation may be described by the following equation:

$$|H_1(k,\omega)|^2\approx|H_2(k,\omega)|^2\approx|H(k,\omega)|^2 \tag{12}$$

It may also be assumed that almost the power of noise signals $N_1(k, \omega)$ and $N_2(k, \omega)$ may be received by the microphone 432 and the microphone 434. Thus, the noise power may be described by the following equation:

$$|\Phi_{N1N1}(k,\omega)|^2\approx|\Phi_{N2N2}(k,\omega)|^2\approx|\Phi_{NN}(k,\omega)|^2 \tag{13}$$

A statistics estimation block 410 may perform operations to estimate auto and cross periodograms (e.g., in a real time system) by averaging:

$$\Phi_{XiXj}(k,\omega)=\alpha\cdot\Phi_{XiXj}(k-1,\omega)+(1-\alpha)\cdot X_i(k,\omega)\cdot X_j^*(k,\omega) \tag{14}$$

where the time constant α may be tuned to balance (wind presence) estimation accuracy and adapting to changing coherence properties, in part because wind may be highly non-stationary.

Further, a noise estimation block 412 may perform operations to determine a magnitude-squared cross power spectrum of the microphone signals by the following equations:

$$\left|\Phi_{X_1X_2}(k,\omega)\right|^2 = |E\{X_1(k,\omega)\cdot X_2(k,w)^*\}|^2 \tag{15}$$

$$= E\{|S(k,\omega)|^2\}\cdot|H1(k,\omega)|^2\cdot|H2(k,\omega)|^2 \tag{16}$$

$$= E\{|S(k,\omega)|^2\}\cdot|H(k,\omega)|^4 \tag{17}$$

The noise estimation block 412 may also determine a product of a power spectra of microphone signals (e.g., the first and second audio signals) by the equations:

$$\Phi_{X_1X_1}(k,\omega)\cdot\Phi_{X_2X_2}(k,\omega) = |E\{X_1(k,\omega)\}|^2\cdot|E\{X_2(k,\omega)\}|^2 \tag{18}$$

$$= E\{|N_1(k,\omega)|^2\}\cdot E\{|N_2(k,\omega)|^2\} + E\{|S(k,\omega)|^2\}^2\cdot|H_1(k,\omega)|^2\cdot|H_2(k,\omega)|^2 + E\{|S(k,\omega)|^2\}(|H_1(k,\omega)|^2\cdot E\{|N_2(k,\omega)|^2\}+|H_2(k,\omega)|^2\cdot E\{|N_1(k,\omega)|^2\}) \tag{19}$$

$$= \left(E\{|N(k,\omega)|^2\}+|H(k,\omega)|^2\cdot E\{|S(k,\omega)|^2\}\right)^2 \tag{20}$$

$$= \left(\Phi_N(k,\omega)+|H(k,\omega)|^2\cdot E\{|S(k,\omega)|^2\}\right)^2 \tag{21}$$

The noise estimation block 412 may also determine a noise estimate by the equation:

$$\Phi N(k,\omega)=\sqrt{\Phi_{X_1X_1}(k,\omega)\cdot\Phi_{X_2X_2}(k,\omega)}-|\Phi_{X_1X_2}(k,\omega)| \tag{22}$$

Thus, the suppression component 632 may determine the noise estimate based on the power spectrum of the first and second audio signals.

An alignment block 408 may represent aligned microphone signals by the equation (e.g., to facilitate checking whether the two microphones signals are coherent and determining a signal to noise ratio (e.g., SNR):

$$A(k,\omega) = \frac{X_1(k,\omega)X_2^*(k,\omega)}{\max(|X_1(k,\omega)|\cdot|X_2(k,\omega)|,\ \in)} \tag{23}$$

where ϵ may be a relatively small number. Thus, the suppression component 632 may determine a coherence of the microphone signals (e.g., the first and second audio signals).

A gain estimation block 414 may determine a gain to be applied to both microphone signals by the equation:

$$G(k,\omega) = \left(1-\left(\frac{\Phi_N(k,\omega)}{\max(|\Phi_{X1X2}(k,\omega)|,\ \in)}\right)^2\right)^{\frac{1}{2}} \tag{24}$$

where a cross power spectrum ($|\Phi_{X1X2}(k, \omega)|$ may used instead of the microphone signal $|X_1(k, \omega)|^2$ or $|X_2(k, \omega)|^2$ which may be may be noisy but may still be typically used for traditional spectral subtraction. Thus, the suppression component 632 may determine (180) the cross power spectrum based on the microphone signals (e.g., the first and second audio signals). The cross power spectrum may indicate a correlation between the two microphones. If the two microphone signals are correlated (which may indicate speech presence), the suppression due to the gain may be reduced. If the two microphone signals are not correlated (which may indicate wind presence), the suppression due to the gain may be increased. The amount of suppression may be limited by the equation:

$$\tilde{G}(k,\omega)=\max(G(k,\omega),G_{min}(k,\omega)) \tag{25}$$

Further, the suppression component 632 may determine (182) the gain based on the cross power spectrum of the microphone signals (e.g., the first and second audio signals). Further, the suppression component 632 may process (184) the first and second audio signals to determine first and second audio signals (e.g., based on the gain). For example, the gain blocks 416 and 418 may apply the gain suppression to both microphone signals, respectively.

After applying the gain suppression, a statistics estimation block 420 may re-estimate statistics of the microphone signals (e.g., as was performed by statistics estimation block 410). Further, a post filter estimation block 422 may determine:

$$W_1(k,\omega)=\frac{|\tilde{\Phi}\tilde{x}_1\tilde{x}_2(k,\omega)|}{\tilde{\Phi}\tilde{x}_1\tilde{x}_1(k,\omega)+\in} \tag{26}$$

$$W_2(k,\omega)=\frac{|\tilde{\Phi}\tilde{x}_1\tilde{x}_2(k,\omega)|}{\tilde{\Phi}\tilde{x}_2\tilde{x}_2(k,\omega)+\in} \tag{27}$$

The post filter may be a zero-phase Wiener filter which may minimize the difference between the two microphone channels/signals. The post filter blocks 424 and 426 may apply the post filter to both microphone signals as follows:

$$W(k,\omega)=\min(W_1(k,\omega),W_2(k,\omega)) \tag{28}$$

The amount of attenuation may be limited by the equation:

$$\tilde{W}(k,\omega)=\max(W(k,\omega),W_{min}(k,\omega)) \tag{29}$$

Thus, the suppression component 632 may process (186) the suppressed microphone signals (e.g., the first and second suppressed audio signals) to determine attenuated microphone signals (e.g., first and second attenuated audio signals).

In some embodiments, the maximum attenuation may be restricted over time and/or frequency to have a high pass filter characteristic for the maximum attenuation that can be applied. In other words, less attenuation may be applied at high frequencies (e.g., where speech may be present) and more attenuation may be applied at lower frequencies (e.g., where wind noise may be present) as wind noise may predominately impacts low frequencies and higher frequencies may be less coherent in general. To achieve this, a sigmoid function may define a maximum attenuation per band by the following equation:

$$\sigma(\omega,\alpha,\beta,s,\omega_{mid})=\frac{\alpha+(\beta-\alpha)}{1+e^{(-s\cdot(\omega-\omega_{mid}))}} \tag{30}$$

where $\alpha$ may be a min value, $\beta$ may be a max value, s may be a slope, and comic may be a mid-point, all of which may be tunable parameters. The following equations result:

$$W_{min}(\omega)=\sigma(\omega,\alpha,\beta,s,\omega_{mid}) \tag{31}$$

$$G_{min}(\omega)=\sigma(\omega,\alpha,\beta,s,\omega_{mid}) \tag{32}$$

In some embodiments, the limits determined above may be time-dependent. For example, less attenuation may be applied when speech is detected. Further, the suppression component 632 may apply greater attenuation to the first and second suppressed audio signals at frequencies ranges corresponding to wind presence (e.g., 1-5 kilohertz), than at frequencies corresponding to speech presence (e.g., greater than 5 kilohertz). Additionally, the midpoints and slopes may be varied dependent on a strength of the wind.

The suppression component 632 may output signals Y1 and Y2 which may correspond to suppressed and/or attenuated microphone signals X1 and X2. In some embodiments, the output signals Y1 and Y2 may be further processed by other components of the device 110 which may create audio data 611 corresponding to the output signals Y1 and Y2. Further, in some embodiments, the audio data 611, as shown in FIGS. 6 and/or 7, may be sent to the system 120 for further processing.

Figure 5:
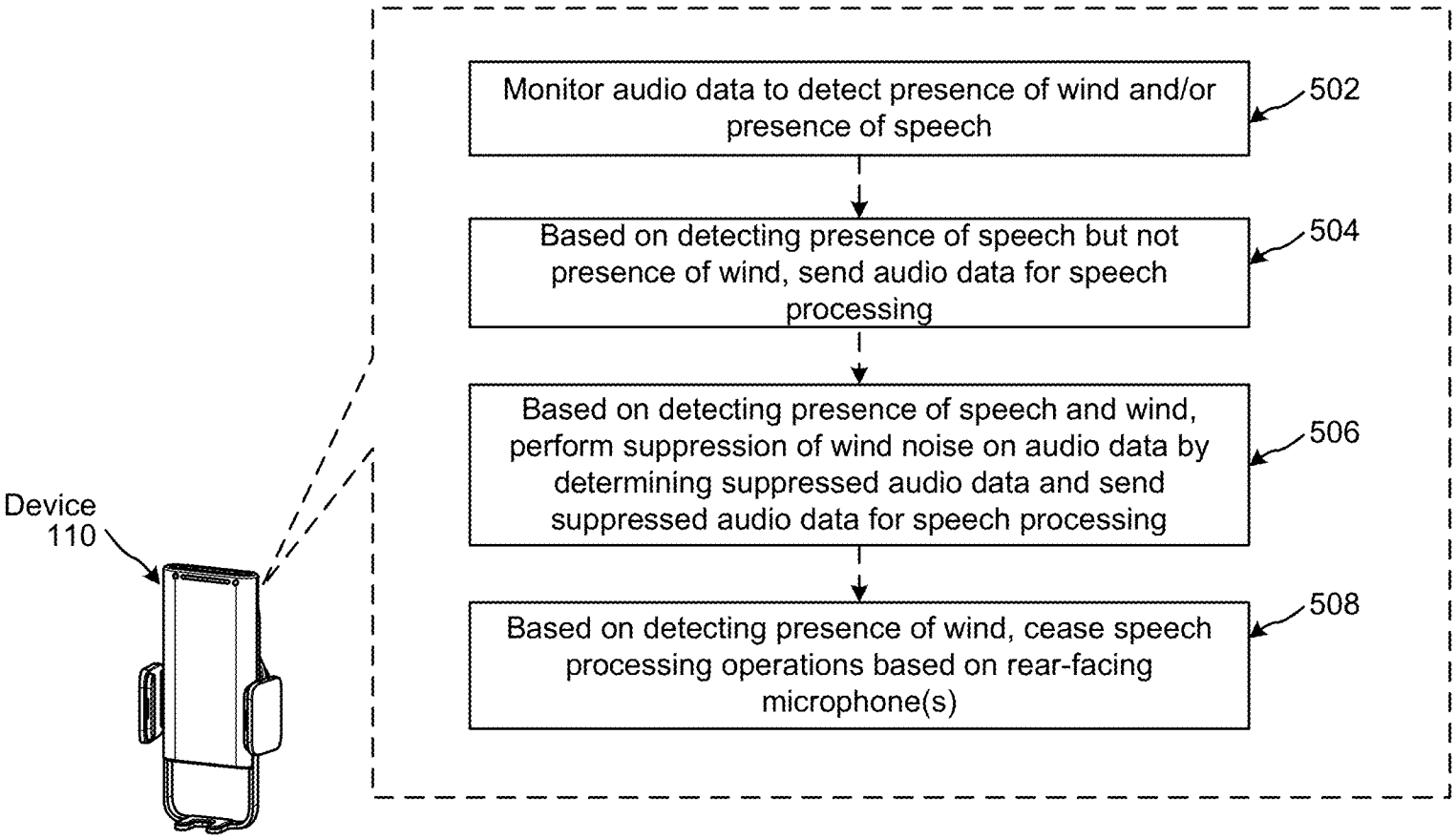
FIG. 5 is a conceptual diagram illustrating operations for noise detection and suppression, according to embodiments of the present disclosure.
Figure 7:
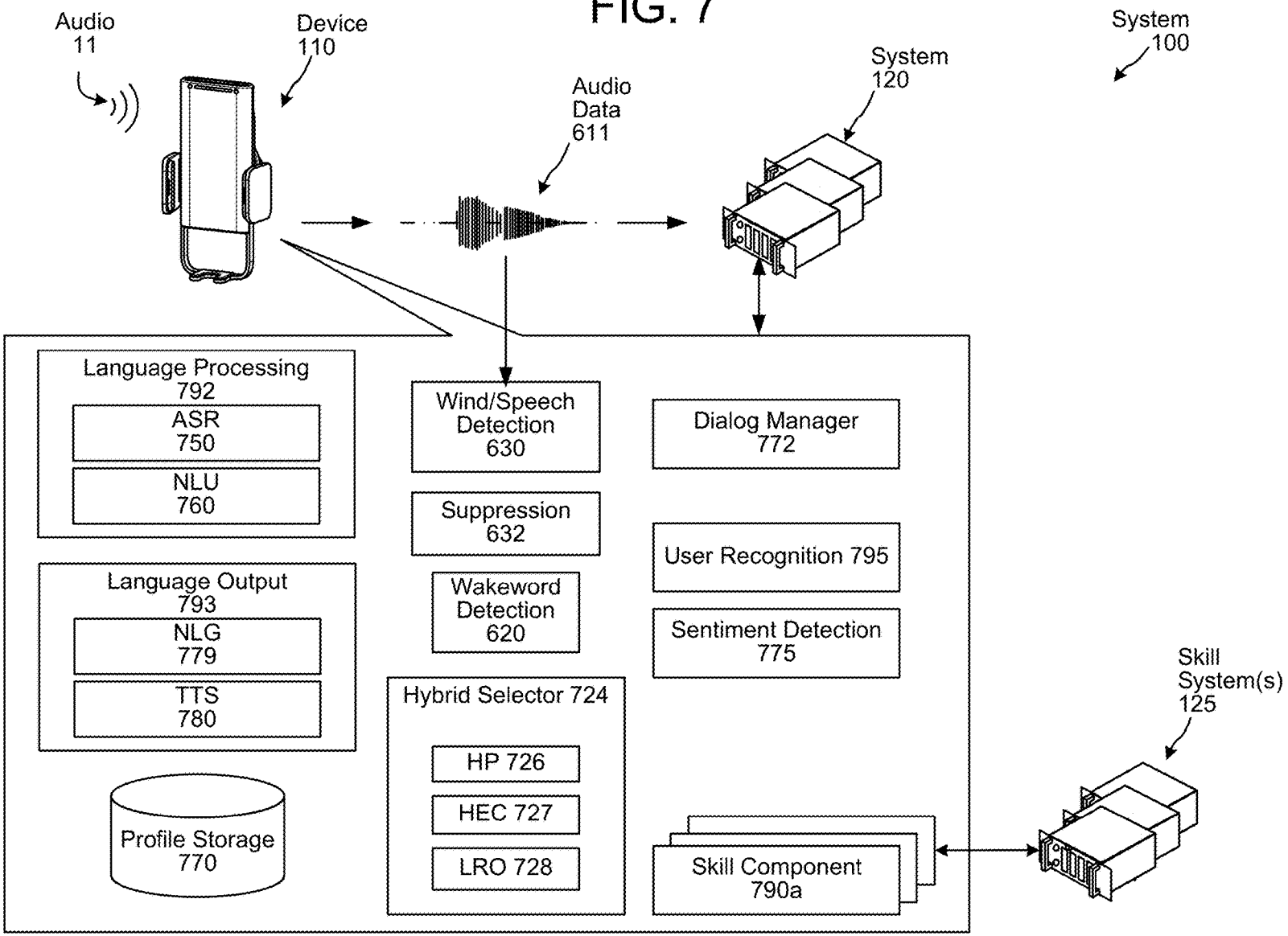
FIG. 7 is a conceptual diagram illustrating components that may be included in a device, according to embodiments of the present disclosure.

Referring now to FIG. 5, a conceptual diagram illustrating operations for noise detection and suppression, according to embodiments of the present disclosure, is shown. The operations shown in FIG. 5 will be described as being performed by the device 110 for illustrative purposes only, however in some embodiments the operations may be performed by the system 120 (not shown). Further, in some embodiments, some of the operations shown in FIG. 5 may be performed by the device 110 while other of the operations may be performed by the system 120. Further, as will be described below, the wind/speech detection component 634 and/or the noise suppression component 632 of the device 110 (or the system 120) (e.g., as shown in FIGS. 6 and 7) may perform some or all of the operations shown in FIG. 5.

The wind/speech detection component 634 may monitor (502) audio data from one or more microphones of the device 110 to detect a presence of wind and/or a presence of speech using the techniques and features described by the present disclosure (e.g., operations 150-156 as shown in FIG. 1). The audio data (e.g., first and second audio data) may correspond to audio signals (e.g., first and second audio signals) received or determined by the one or more microphones of the device 110, as described above. For example, the wind/speech detection component 634 may detect the presence of speech but not the presence of wind based on the audio data. Based on detecting the presence of speech but not the presence of wind, the wind/speech detection component 634 may send (504) the audio data for speech processing (e.g., by one or more components of the device 110 and/or the system 120).

Further, the wind/speech detection component 634 may detect the presence of speech and the presence of wind based on the audio data. Based on detecting the presence of speech and the presence of wind by the wind/speech detection component 634, the noise suppression component 632 may perform (506) suppression of wind noise (associated with the wind) on the audio data by determining suppressed audio data or audio signals using the techniques and features described by the present disclosure (e.g., operations 180-186 as shown in FIG. 1). The suppressed audio data may be sent to one or more components of the device 110 (or the system 120) for speech processing.

It should be noted that the term "suppressed audio data" (e.g., including first suppressed audio data and second suppressed audio data) may refer to audio data processed with gain suppression features (e.g., gain blocks 416 and/or 418) as described by the present disclosure. Further, the term "suppressed audio data" may also refer to attenuated audio data (e.g., including first attenuated audio data and second attenuated audio data) processed with post filter features (e.g., post filter blocks 424 and/or 426) as described by the present disclosure.

In some embodiments, it may be desirable to process audio and/or speech using certain microphones of the device 110 based on the detection of the presence of wind and cease processing of the audio and/or speech by other microphones of the device 110. For example, if wind is detected, the wind may be caused by a vent of a vehicle in which the device 110 is used, and rear-facing microphones of the device 110 may be more exposed to the wind than front-facing microphones of the device 110. Thus, in the presence of wind (e.g., caused by the vent), speech processing operations based on the rear-facing microphones may not be performed and while speech processing operations based on the front-facing microphones may continue to be performed or may initialize. In other words, based on detecting the presence of wind by the wind/speech detection component 634, the device 110 may cease (508) speech processing operations based on the rear-facing microphones.

The system 100 may operate using various components as described in FIG. 6. The various components may be located on same or different physical devices. Communication between various components may occur directly or across a network(s) 199. The device 110 may include audio capture component(s), such as a microphone or array of microphones of a device 110, captures audio 11 and creates corresponding audio data. Once speech is detected in audio data representing the audio 11, the device 110 may determine if the speech is directed at the device 110/system 120. In at least some embodiments, such determination may be made using a wakeword detection component 620. The wakeword detection component 620 may be configured to detect various wakewords. In at least some examples, each wakeword may correspond to a name of a different digital assistant. An example wakeword/digital assistant name is "Alexa." In another example, input to the system may be in form of text data 613, for example as a result of a user typing an input into a user interface of device 110. Other input forms may include indication that the user has pressed a physical or virtual button on device 110, the user has made a gesture, etc. The device 110 may also capture images using camera(s) 818 of the device 110 and may send image data 621 representing those image(s) to the system 120. The image data 621 may include raw image data or image data processed by the device 110 before sending to the system 120.

The wakeword detector 620 of the device 110 may process the audio data, representing the audio 11, to determine whether speech is represented therein. The device 110 may use various techniques to determine whether the audio data includes speech. In some examples, the device 110 may apply voice-activity detection (VAD) techniques. Such techniques may determine whether speech is present in audio data based on various quantitative aspects of the audio data, such as the spectral slope between one or more frames of the audio data; the energy levels of the audio data in one or more spectral bands; the signal-to-noise ratios of the audio data in one or more spectral bands; or other quantitative aspects. In other examples, the device 110 may implement a classifier configured to distinguish speech from background noise. The classifier may be implemented by techniques such as linear classifiers, support vector machines, and decision trees. In still other examples, the device 110 may apply hidden Markov model (HMM) or Gaussian mixture model (GMM) techniques to compare the audio data to one or more acoustic models in storage, which acoustic models may include models corresponding to speech, noise (e.g., environmental noise or background noise), or silence. Still other techniques may be used to determine whether speech is present in audio data.

Wakeword detection is typically performed without performing linguistic analysis, textual analysis, or semantic analysis. Instead, the audio data, representing the audio 11, is analyzed to determine if specific characteristics of the audio data match preconfigured acoustic waveforms, audio signatures, or other data corresponding to a wakeword.

Thus, the wakeword detection component 620 may compare audio data to stored data to detect a wakeword. One approach for wakeword detection applies general large vocabulary continuous speech recognition (LVCSR) systems to decode audio signals, with wakeword searching being conducted in the resulting lattices or confusion networks. Another approach for wakeword detection builds HMMs for each wakeword and non-wakeword speech signals, respectively. The non-wakeword speech includes other spoken words, background noise, etc. There can be one or more HMMs built to model the non-wakeword speech characteristics, which are named filler models. Viterbi decoding is used to search the best path in the decoding graph, and the decoding output is further processed to make the decision on wakeword presence. This approach can be extended to include discriminative information by incorporating a hybrid DNN-HMM decoding framework. In another example, the wakeword detection component 620 may be built on deep neural network (DNN)/recursive neural network (RNN) structures directly, without HMM being involved. Such an architecture may estimate the posteriors of wakewords with context data, either by stacking frames within a context window for DNN, or using RNN. Follow-on posterior threshold tuning or smoothing is applied for decision making. Other techniques for wakeword detection, such as those known in the art, may also be used.

Once the wakeword is detected by the wakeword detector 620 and/or input is detected by an input detector, the device 110 may "wake" and begin transmitting audio data 611, representing the audio 11, to the system(s) 120. The audio data 611 may include data corresponding to the wakeword; in other embodiments, the portion of the audio corresponding to the wakeword is removed by the device 110 prior to sending the audio data 611 to the system(s) 120. In the case of touch input detection or gesture based input detection, the audio data may not include a wakeword.

In some implementations, the system 100 may include more than one system 120. The systems 120 may respond to different wakewords and/or perform different categories of tasks. Each system 120 may be associated with its own wakeword such that speaking a certain wakeword results in audio data be sent to and processed by a particular system. For example, detection of the wakeword "Alexa" by the wakeword detector 620 may result in sending audio data to system 120*a* for processing while detection of the wakeword "Computer" by the wakeword detector may result in sending audio data to system 120*b* for processing. The system may have a separate wakeword and system for different skills/systems (e.g., "Dungeon Master" for a game play skill/ system 120*c*) and/or such skills/systems may be coordinated by one or more skill(s) 690 of one or more systems 120.

Upon receipt by the system(s) 120, the audio data 611 may be sent to an orchestrator component 630. The orchestrator component 630 may include memory and logic that enables the orchestrator component 630 to transmit various pieces and forms of data to various components of the system, as well as perform other operations as described herein.

The orchestrator component 630 may send the audio data 611 to a language processing component 692. The language processing component 692 (sometimes also referred to as a spoken language understanding (SLU) component) includes an automatic speech recognition (ASR) component 650 and a natural language understanding (NLU) component 660. The ASR component 650 may transcribe the audio data 611 into text data. The text data output by the ASR component 650 represents one or more than one (e.g., in the form of an N-best list) ASR hypotheses representing speech represented in the audio data 611. The ASR component 650 interprets the speech in the audio data 611 based on a similarity between the audio data 611 and pre-established language models. For example, the ASR component 650 may compare the audio data 611 with models for sounds (e.g., acoustic units such as phonemes, senons, phones, etc.) and sequences of sounds to identify words that match the sequence of sounds of the speech represented in the audio data 611. The ASR component 650 sends the text data generated thereby to an NLU component 660, via, in some embodiments, the orchestrator component 630. The text data sent from the ASR component 650 to the NLU component 660 may include a single top-scoring ASR hypothesis or may include an N-best list including multiple top-scoring ASR hypotheses. An N-best list may additionally include a respective score associated with each ASR hypothesis represented therein. The ASR component 650 is described in greater detail below with regard to FIG. 3.

The speech processing system 692 may further include a NLU component 660. The NLU component 660 may receive the text data from the ASR component. The NLU component 660 may attempts to make a semantic interpretation of the phrase(s) or statement(s) represented in the text data input therein by determining one or more meanings associated with the phrase(s) or statement(s) represented in the text data. The NLU component 660 may determine an intent representing an action that a user desires be performed and may determine information that allows a device (e.g., the device 110, the system(s) 120, a skill component 690, a skill system(s) 125, etc.) to execute the intent. For example, if the text data corresponds to "play the 5$^{th}$ Symphony by Beethoven," the NLU component 660 may determine an intent that the system output music and may identify "Beethoven" as an artist/composer and "5th Symphony" as the piece of music to be played. For further example, if the text data corresponds to "what is the weather," the NLU component 660 may determine an intent that the system output weather information associated with a geographic location of the device 110. In another example, if the text data corresponds to "turn off the lights," the NLU component 660 may determine an intent that the system turn off lights associated with the device 110 or the user 5. However, if the NLU component 660 is unable to resolve the entity—for example, because the entity is referred to by anaphora such as "this song" or "my next appointment"—the speech processing system 692 can send a decode request to another speech processing system 692 for information regarding the entity mention and/or other context related to the utterance. The speech processing system 692 may augment, correct, or base results data upon the audio data 611 as well as any data received from the other speech processing system 692.

The NLU component 660 may return NLU results data (which may include tagged text data, indicators of intent, etc.) back to the orchestrator 630. The orchestrator 630 may forward the NLU results data to a skill component(s) 690. If the NLU results data includes a single NLU hypothesis, the NLU component 660 and the orchestrator component 630 may direct the NLU results data to the skill component(s) 690 associated with the NLU hypothesis. If the NLU results data includes an N-best list of NLU hypotheses, the NLU component 660 and the orchestrator component 630 may direct the top scoring NLU hypothesis to a skill component(s) 690 associated with the top scoring NLU hypothesis.

A skill component may be software running on the system(s) 120 that is akin to a software application. That is, a skill component 690 may enable the system(s) 120 to execute specific functionality in order to provide data or produce some other requested output. As used herein, a "skill component" may refer to software that may be placed on a machine or a virtual machine (e.g., software that may be launched in a virtual instance when called). A skill component may be software customized to perform one or more actions as indicated by a business entity, device manufacturer, user, etc. What is described herein as a skill component may be referred to using many different terms, such as an action, bot, app, or the like. The system(s) 120 may be configured with more than one skill component 690. For example, a weather service skill component may enable the system(s) 120 to provide weather information, a car service skill component may enable the system(s) 120 to book a trip with respect to a taxi or ride sharing service, a restaurant skill component may enable the system(s) 120 to order a pizza with respect to the restaurant's online ordering system, etc. A skill component 690 may operate in conjunction between the system(s) 120 and other devices, such as the device 110, in order to complete certain functions. Inputs to a skill component 690 may come from speech processing interactions or through other interactions or input sources. A skill component 690 may include hardware, software, firmware, or the like that may be dedicated to a particular skill component 690 or shared among different skill components 690.

A skill support system(s) 125 may communicate with a skill component(s) 690 within the system(s) 120 and/or directly with the orchestrator component 630 or with other components. A skill support system(s) 125 may be configured to perform one or more actions. An ability to perform such action(s) may sometimes be referred to as a "skill." That is, a skill may enable a skill support system(s) 125 to execute specific functionality in order to provide data or perform some other action requested by a user. For example, a weather service skill may enable a skill support system(s) 125 to provide weather information to the system(s) 120, a car service skill may enable a skill support system(s) 125 to book a trip with respect to a taxi or ride sharing service, an order pizza skill may enable a skill support system(s) 125 to order a pizza with respect to a restaurant's online ordering system, etc. Additional types of skills include home automation skills (e.g., skills that enable a user to control home devices such as lights, door locks, cameras, thermostats, etc.), entertainment device skills (e.g., skills that enable a user to control entertainment devices such as smart televisions), video skills, flash briefing skills, as well as custom skills that are not associated with any pre-configured type of skill.

The system(s) 120 may be configured with a skill component 690 dedicated to interacting with the skill support system(s) 125. Unless expressly stated otherwise, reference to a skill, skill device, or skill component may include a skill component 690 operated by the system(s) 120 and/or skill operated by the skill support system(s) 125. Moreover, the functionality described herein as a skill or skill may be referred to using many different terms, such as an action, bot, app, or the like. The skill 690 and or skill support system(s) 125 may return output data to the orchestrator 630.

Dialog processing is a field of computer science that involves communication between a computing system and a human via text, audio, and/or other forms of communication. While some dialog processing involves only simple generation of a response given only a most recent input from a user (i.e., single-turn dialog), more complicated dialog processing involves determining and optionally acting on one or more goals expressed by the user over multiple turns of dialog, such as making a restaurant reservation and/or booking an airline ticket. These multi-turn "goal-oriented" dialog systems typically need to recognize, retain, and use information collected during more than one input during a back-and-forth or "multi-turn" interaction with the user.

The system(s) 100 may include a dialog manager component 672 that manages and/or tracks a dialog between a user and a device. As used herein, a "dialog" may refer to data transmissions (such as relating to multiple user inputs and system 100 outputs) between the system 100 and a user (e.g., through device(s) 110) that all relate to a single "conversation" between the system and the user that may have originated with a single user input initiating the dialog. Thus, the data transmissions of a dialog may be associated with a same dialog identifier, which may be used by components of the overall system 100 to track information across the dialog. Subsequent user inputs of the same dialog may or may not start with speaking of a wakeword. Each natural language input of a dialog may be associated with a different natural language input identifier such that multiple natural language input identifiers may be associated with a single dialog identifier. Further, other non-natural language inputs (e.g., image data, gestures, button presses, etc.) may relate to a particular dialog depending on the context of the inputs. For example, a user may open a dialog with the system 100 to request a food delivery in a spoken utterance and the system may respond by displaying images of food available for order and the user may speak a response (e.g., "item 1" or "that one") or may gesture a response (e.g., point to an item on the screen or give a thumbs-up) or may touch the screen on the desired item to be selected. Non-speech inputs (e.g., gestures, screen touches, etc.) may be part of the dialog and the data associated therewith may be associated with the dialog identifier of the dialog.

The dialog manager component 672 may associate a dialog session identifier with the dialog upon identifying that the user is engaging in a dialog with the user. The dialog manager component 672 may track a user input and the corresponding system generated response to the user input as a turn. The dialog session identifier may correspond to multiple turns of user input and corresponding system generated response. The dialog manager component 672 may transmit data identified by the dialog session identifier directly to the orchestrator component 630 or other component. Depending on system configuration the dialog manager 672 may determine the appropriate system generated response to give to a particular utterance or user input of a turn. Or creation of the system generated response may be managed by another component of the system (e.g., the language output component 693, NLG 679, orchestrator 630, etc.) while the dialog manager 672 selects the appropriate responses. Alternatively, another component of the system(s) 120 may select responses using techniques discussed herein. The text of a system generated response may be sent to a TTS component 680 for creation of audio data corresponding to the response. The audio data may then be sent to a user device (e.g., device 110) for ultimate output to the user. Alternatively (or in addition) a dialog response may be returned in text or some other form.

The dialog manager 672 may receive the ASR hypothesis/hypotheses (i.e., text data) and make a semantic interpretation of the phrase(s) or statement(s) represented therein. That is, the dialog manager 672 determines one or more meanings associated with the phrase(s) or statement(s) represented in the text data based on words represented in the text data. The dialog manager 672 determines a goal corresponding to an action that a user desires be performed as well as pieces of the text data that allow a device (e.g., the device 110, the system(s) 120, a skill 690, a skill system(s) 125, etc.) to execute the intent. If, for example, the text data corresponds to "what is the weather," the dialog manager 672 may determine that that the system(s) 120 is to output weather information associated with a geographic location of the device 110. In another example, if the text data corresponds to "turn off the lights," the dialog manager 672 may determine that the system(s) 120 is to turn off lights associated with the device(s) 110 or the user(s) 5.

The dialog manager 672 may send the results data to one or more skill(s) 690. If the results data includes a single hypothesis, the orchestrator component 630 may send the results data to the skill(s) 690 associated with the hypothesis. If the results data includes an N-best list of hypotheses, the orchestrator component 630 may send the top scoring hypothesis to a skill(s) 690 associated with the top scoring hypothesis.

The system 120 includes a language output component 693. The language output component 693 includes a natural language generation (NLG) component 679 and a text-to-speech (TTS) component 680. The NLG component 679 can generate text for purposes of TTS output to a user. For example the NLG component 679 may generate text corresponding to instructions corresponding to a particular action for the user to perform. The NLG component 679 may generate appropriate text for various outputs as described herein. The NLG component 679 may include one or more trained models configured to output text appropriate for a particular input. The text output by the NLG component 679 may become input for the TTS component 680. Alternatively or in addition, the TTS component 680 may receive text data from a skill 690 or other system component for output.

The NLG component 679 may include a trained model. The NLG component 679 generates text data from dialog data received by the dialog manager 672 such that the output text data has a natural feel and, in some embodiments, includes words and/or phrases specifically formatted for a requesting individual. The NLG may use templates to formulate responses. And/or the NLG system may include models trained from the various templates for forming the output text data. For example, the NLG system may analyze transcripts of local news programs, television shows, sporting events, or any other media program to obtain common components of a relevant language and/or region. As one illustrative example, the NLG system may analyze a transcription of a regional sports program to determine commonly used words or phrases for describing scores or other sporting news for a particular region. The NLG may further receive, as inputs, a dialog history, an indicator of a level of formality, and/or a command history or other user history such as the dialog history.

The NLG system may generate dialog data based on one or more response templates. Further continuing the example above, the NLG system may select a template in response to the question, "What is the weather currently like?" of the form: "The weather currently is $weather_information$." The NLG system may analyze the logical form of the template to produce one or more textual responses including markups and annotations to familiarize the response that is generated. In some embodiments, the NLG system may determine which response is the most appropriate response to be selected. The selection may, therefore, be based on past responses, past questions, a level of formality, and/or any other feature, or any other combination thereof. Responsive audio data representing the response generated by the NLG system may then be generated using the text-to-speech component 680.

The TTS component 680 may generate audio data (e.g., synthesized speech) from text data using one or more different methods. Text data input to the TTS component 680 may come from a skill component 690, the orchestrator component 630, or another component of the system. In one method of synthesis called unit selection, the TTS component 680 matches text data against a database of recorded speech. The TTS component 680 selects matching units of recorded speech and concatenates the units together to form audio data. In another method of synthesis called parametric synthesis, the TTS component 680 varies parameters such as frequency, volume, and noise to create audio data including an artificial speech waveform. Parametric synthesis uses a computerized voice generator, sometimes called a vocoder.

The device 110 may include still image and/or video capture components such as a camera or cameras to capture one or more images. The device 110 may include circuitry for digitizing the images and/or video for transmission to the system(s) 120 as image data. The device 110 may further include circuitry for voice command-based control of the camera, allowing a user 5 to request capture of image or video data. The device 110 may process the commands locally or send audio data 611 representing the commands to the system(s) 120 for processing, after which the system(s) 120 may return output data that can cause the device 110 to engage its camera.

The system(s) 120 may include a user recognition component 695 that recognizes one or more users using a variety of data. However, the disclosure is not limited thereto, and the device 110 may include a user recognition component 795 instead of and/or in addition to user recognition component 695 of the system(s) 120 without departing from the disclosure. User recognition component 795 operates similarly to user recognition component 695.

The user-recognition component 695 may take as input the audio data 611 and/or text data output by the ASR component 650. The user-recognition component 695 may perform user recognition by comparing audio characteristics in the audio data 611 to stored audio characteristics of users. The user-recognition component 695 may also perform user recognition by comparing biometric data (e.g., fingerprint data, iris data, etc.), received by the system in correlation with the present user input, to stored biometric data of users assuming user permission and previous authorization. The user-recognition component 695 may further perform user recognition by comparing image data (e.g., including a representation of at least a feature of a user), received by the system in correlation with the present user input, with stored image data including representations of features of different users. The user-recognition component 695 may perform additional user recognition processes, including those known in the art.

The user-recognition component 695 determines scores indicating whether user input originated from a particular user. For example, a first score may indicate a likelihood that the user input originated from a first user, a second score may indicate a likelihood that the user input originated from a second user, etc. The user-recognition component 695 also determines an overall confidence regarding the accuracy of user recognition operations.

Output of the user-recognition component 695 may include a single user identifier corresponding to the most likely user that originated the user input. Alternatively, output of the user-recognition component 695 may include an N-best list of user identifiers with respective scores indicating likelihoods of respective users originating the user input. The output of the user-recognition component 695 may be used to inform NLU processing as well as processing performed by other components of the system.

The system 100 (either on device 110, system 120, or a combination thereof) may include profile storage for storing a variety of information related to individual users, groups of users, devices, etc. that interact with the system. As used herein, a "profile" refers to a set of data associated with a user, group of users, device, etc. The data of a profile may include preferences specific to the user, device, etc.; input and output capabilities of the device; internet connectivity information; user bibliographic information; subscription information, as well as other information.

The profile storage 670 may include one or more user profiles, with each user profile being associated with a different user identifier/user profile identifier. Each user profile may include various user identifying data. Each user profile may also include data corresponding to preferences of the user. Each user profile may also include preferences of the user and/or one or more device identifiers, representing one or more devices of the user. For instance, the user account may include one or more IP addresses, MAC addresses, and/or device identifiers, such as a serial number, of each additional electronic device associated with the identified user account. When a user logs into to an application installed on a device 110, the user profile (associated with the presented login information) may be updated to include information about the device 110, for example with an indication that the device is currently in use. Each user profile may include identifiers of skills that the user has enabled. When a user enables a skill, the user is providing the system 120 with permission to allow the skill to execute with respect to the user's natural language user inputs. If a user does not enable a skill, the system 120 may not invoke the skill to execute with respect to the user's natural language user inputs.

The profile storage 670 may include one or more group profiles. Each group profile may be associated with a different group identifier. A group profile may be specific to a group of users. That is, a group profile may be associated with two or more individual user profiles. For example, a group profile may be a household profile that is associated with user profiles associated with multiple users of a single household. A group profile may include preferences shared by all the user profiles associated therewith. Each user profile associated with a group profile may additionally include preferences specific to the user associated therewith. That is, each user profile may include preferences unique from one or more other user profiles associated with the same group profile. A user profile may be a stand-alone profile or may be associated with a group profile.

The profile storage 670 may include one or more device profiles. Each device profile may be associated with a different device identifier. Each device profile may include various device identifying information. Each device profile may also include one or more user identifiers, representing one or more users associated with the device. For example, a household device's profile may include the user identifiers of users of the household.

The system(s) 120 may also include a sentiment detection component 675 that may be configured to detect a sentiment of a user from audio data representing speech/utterances from the user, image data representing an image of the user, and/or the like. The sentiment detection component 675 may be included in system(s) 120, as illustrated in FIG. 6, although the disclosure is not limited thereto and the sentiment detection component 675 may be included in other components without departing from the disclosure. For example the sentiment detection component 775 may be included in the device 110, as a separate component, etc. Sentiment detection component 775 may operate similarly to sentiment detection component 675. The system 120 may use the sentiment detection component 675 to, for example, customize a response for a user based on an indication that the user is happy or frustrated.

Although the components of FIG. 6 may be illustrated as part of system(s) 120, device 110, or otherwise, the components may be arranged in other device(s) (such as in device 110 if illustrated in system(s) 120 or vice-versa, or in other device(s) altogether) without departing from the disclosure. FIG. 7 illustrates such a configured device 110.

In at least some embodiments, the system 120 may receive the audio data 611 from the device 110, to recognize speech corresponding to a spoken input in the received audio data 611, and to perform functions in response to the recognized speech. In at least some embodiments, these functions involve sending directives (e.g., commands), from the system 120 to the device 110 (and/or other devices 110) to cause the device 110 to perform an action, such as output an audible response to the spoken input via a loudspeaker(s), and/or control secondary devices in the environment by sending a control command to the secondary devices.

Thus, when the device 110 is able to communicate with the system 120 over the network(s) 199, some or all of the functions capable of being performed by the system 120 may be performed by sending one or more directives over the network(s) 199 to the device 110, which, in turn, may process the directive(s) and perform one or more corresponding actions. For example, the system 120, using a remote directive that is included in response data (e.g., a remote response), may instruct the device 110 to output an audible response (e.g., using TTS processing performed by an on-device TTS component 780) to a user's question via a loudspeaker(s) of (or otherwise associated with) the device 110, to output content (e.g., music) via the loudspeaker(s) of (or otherwise associated with) the device 110, to display content on a display of (or otherwise associated with) the device 110, and/or to send a directive to a secondary device (e.g., a directive to turn on a smart light). It is to be appreciated that the system 120 may be configured to provide other functions in addition to those discussed herein, such as, without limitation, providing step-by-step directions for navigating from an origin location to a destination location, conducting an electronic commerce transaction on behalf of the user 5 as part of a shopping function, establishing a communication session (e.g., a video call) between the user 5 and another user, and so on.

As noted with respect to FIG. 6, the device 110 may include a wakeword detection component 620 configured to compare the audio data 611 to stored models used to detect a wakeword (e.g., "Alexa") that indicates to the device 110 that the audio data 611 is to be processed for determining NLU output data (e.g., slot data that corresponds to a named entity, label data, and/or intent data, etc.). In at least some embodiments, a hybrid selector 724, of the device 110, may send the audio data 611 to the wakeword detection component 620. If the wakeword detection component 620 detects a wakeword in the audio data 611, the wakeword detection component 620 may send an indication of such detection to the hybrid selector 724. In response to receiving the indication, the hybrid selector 724 may send the audio data 611 to the system 120 and/or the ASR component 750. The wakeword detection component 620 may also send an indication, to the hybrid selector 724, representing a wakeword was not detected. In response to receiving such an indication, the hybrid selector 724 may refrain from sending the audio data 611 to the system 120, and may prevent the ASR component 750 from further processing the audio data 611. In this situation, the audio data 611 can be discarded.

The device 110 may conduct its own speech processing using on-device language processing components, such as an SLU/language processing component 792 (which may include an ASR component 750 and an NLU 760), similar to the manner discussed herein with respect to the SLU component 692 (or ASR component 650 and the NLU component 660) of the system 120. Language processing component 792 may operate similarly to language processing component 692, ASR component 750 may operate similarly to ASR component 650 and NLU component 760 may operate similarly to NLU component 660. The device 110 may also internally include, or otherwise have access to, other components such as one or more skill components 790 capable of executing commands based on NLU output data or other results determined by the device 110/system 120 (which may operate similarly to skill components 690), a user recognition component 795 (configured to process in a similar manner to that discussed herein with respect to the user recognition component 695 of the system 120), profile storage 770 (configured to store similar profile data to that discussed herein with respect to the profile storage 670 of the system 120), or other components. In at least some embodiments, the profile storage 770 may only store profile data for a user or group of users specifically associated with the device 110. Similar to as described above with respect to skill component 690, a skill component 790 may communicate with a skill system(s) 125. The device 110 may also have its own language output component 793 which may include NLG component 779 and TTS component 780. Language output component 793 may operate similarly to language processing component 693, NLG component 779 may operate similarly to NLG component 679 and TTS component 780 may operate similarly to TTS component 680.

In at least some embodiments, the on-device language processing components may not have the same capabilities as the language processing components of the system 120. For example, the on-device language processing components may be configured to handle only a subset of the natural language user inputs that may be handled by the system 120. For example, such subset of natural language user inputs may correspond to local-type natural language user inputs, such as those controlling devices or components associated with a user's home. In such circumstances the on-device language processing components may be able to more quickly interpret and respond to a local-type natural language user input, for example, than processing that involves the system 120. If the device 110 attempts to process a natural language user input for which the on-device language processing components are not necessarily best suited, the language processing results determined by the device 110 may indicate a low confidence or other metric indicating that the processing by the device 110 may not be as accurate as the processing done by the system 120.

The hybrid selector 724, of the device 110, may include a hybrid proxy (HP) 726 configured to proxy traffic to/from the system 120. For example, the HP 726 may be configured to send messages to/from a hybrid execution controller (HEC) 727 of the hybrid selector 724. For example, command/directive data received from the system 120 can be sent to the HEC 727 using the HP 726. The HP 726 may also be configured to allow the audio data 611 to pass to the system 120 while also receiving (e.g., intercepting) this audio data 611 and sending the audio data 611 to the HEC 727.

In at least some embodiments, the hybrid selector 724 may further include a local request orchestrator (LRO) 728 configured to notify the ASR component 750 about the availability of new audio data 611 that represents user speech, and to otherwise initiate the operations of local language processing when new audio data 611 becomes available. In general, the hybrid selector 724 may control execution of local language processing, such as by sending "execute" and "terminate" events/instructions. An "execute" event may instruct a component to continue any suspended execution (e.g., by instructing the component to execute on a previously-determined intent in order to determine a directive). Meanwhile, a "terminate" event may instruct a component to terminate further execution, such as when the device 110 receives directive data from the system 120 and chooses to use that remotely-determined directive data.

Thus, when the audio data 611 is received, the HP 726 may allow the audio data 611 to pass through to the system 120 and the HP 726 may also input the audio data 611 to the on-device ASR component 750 by routing the audio data 611 through the HEC 727 of the hybrid selector 724, whereby the LRO 728 notifies the ASR component 750 of the audio data 611. At this point, the hybrid selector 724 may wait for response data from either or both of the system 120 or the local language processing components. However, the disclosure is not limited thereto, and in some examples the hybrid selector 724 may send the audio data 611 only to the local ASR component 750 without departing from the disclosure. For example, the device 110 may process the audio data 611 locally without sending the audio data 611 to the system 120.

The local ASR component 750 is configured to receive the audio data 611 from the hybrid selector 724, and to recognize speech in the audio data 611, and the local NLU component 760 is configured to determine a user intent from the recognized speech, and to determine how to act on the user intent by generating NLU output data which may include directive data (e.g., instructing a component to perform an action). Such NLU output data may take a form similar to that as determined by the NLU component 660 of the system 120. In some cases, a directive may include a description of the intent (e.g., an intent to turn off {device A}). In some cases, a directive may include (e.g., encode) an identifier of a second device(s), such as kitchen lights, and an operation to be performed at the second device(s). Directive data may be formatted using Java, such as JavaScript syntax, or JavaScript-based syntax. This may include formatting the directive using JSON. In at least some embodiments, a device-determined directive may be serialized, much like how remotely-determined directives may be serialized for transmission in data packets over the network(s) 199. In at least some embodiments, a device-determined directive may be formatted as a programmatic application programming interface (API) call with a same logical operation as a remotely-determined directive. In other words, a device-determined directive may mimic a remotely-determined directive by using a same, or a similar, format as the remotely-determined directive.

An NLU hypothesis (output by the NLU component 760) may be selected as usable to respond to a natural language user input, and local response data may be sent (e.g., local NLU output data, local knowledge base information, internet search results, and/or local directive data) to the hybrid selector 724, such as a "ReadyToExecute" response. The hybrid selector 724 may then determine whether to use directive data from the on-device components to respond to the natural language user input, to use directive data received from the system 120, assuming a remote response is even received (e.g., when the device 110 is able to access the system 120 over the network(s) 199), or to determine output audio requesting additional information from the user 5.

The device 110 and/or the system 120 may associate a unique identifier with each natural language user input. The device 110 may include the unique identifier when sending the audio data 611 to the system 120, and the response data from the system 120 may include the unique identifier to identify which natural language user input the response data corresponds.

In at least some embodiments, the device 110 may include, or be configured to use, one or more skill components 790 that may work similarly to the skill component(s) 690 implemented by the system 120. The skill component(s) 790 may correspond to one or more domains that are used in order to determine how to act on a spoken input in a particular way, such as by outputting a directive that corresponds to the determined intent, and which can be processed to implement the desired operation. The skill component(s) 790 installed on the device 110 may include, without limitation, a smart home skill component (or smart home domain) and/or a device control skill component (or device control domain) to execute in response to spoken inputs corresponding to an intent to control a second device(s) in an environment, a music skill component (or music domain) to execute in response to spoken inputs corresponding to a intent to play music, a navigation skill component (or a navigation domain) to execute in response to spoken input corresponding to an intent to get directions, a shopping skill component (or shopping domain) to execute in response to spoken inputs corresponding to an intent to buy an item from an electronic marketplace, and/or the like.

Additionally or alternatively, the device 110 may be in communication with one or more skill systems 125. For example, a skill system 125 may be located in a remote environment (e.g., separate location) such that the device 110 may only communicate with the skill system 125 via the network(s) 199. However, the disclosure is not limited thereto. For example, in at least some embodiments, a skill system 125 may be configured in a local environment (e.g., home server and/or the like) such that the device 110 may communicate with the skill system 125 via a private network, such as a local area network (LAN).

As used herein, a "skill" may refer to a skill component 790, a skill system 125, or a combination of a skill component 790 and a corresponding skill system 125.

Similar to the manner discussed with regard to FIG. 6, the local device 110 may be configured to recognize multiple different wakewords and/or perform different categories of tasks depending on the wakeword. Such different wakewords may invoke different processing components of local device 110 (not illustrated in FIG. 7). For example, detection of the wakeword "Alexa" by the wakeword detector 620 may result in sending audio data to certain language processing components 792/skills 790 for processing while detection of the wakeword "Computer" by the wakeword detector may result in sending audio data different language processing components 792/skills 790 for processing.

Figure 8:
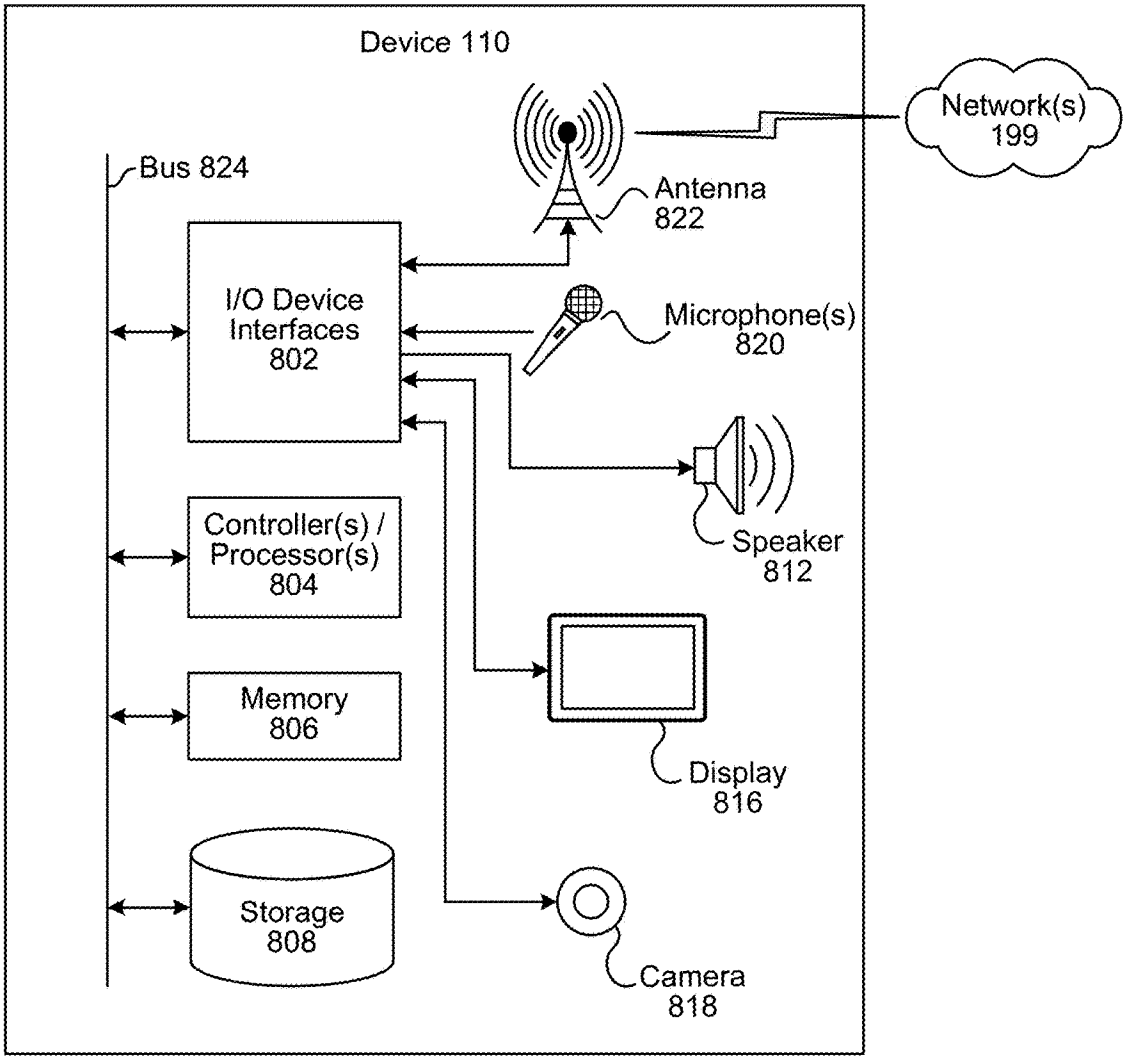
FIG. 8 is a block diagram conceptually illustrating example components of a device, according to embodiments of the present disclosure.
Figure 9:
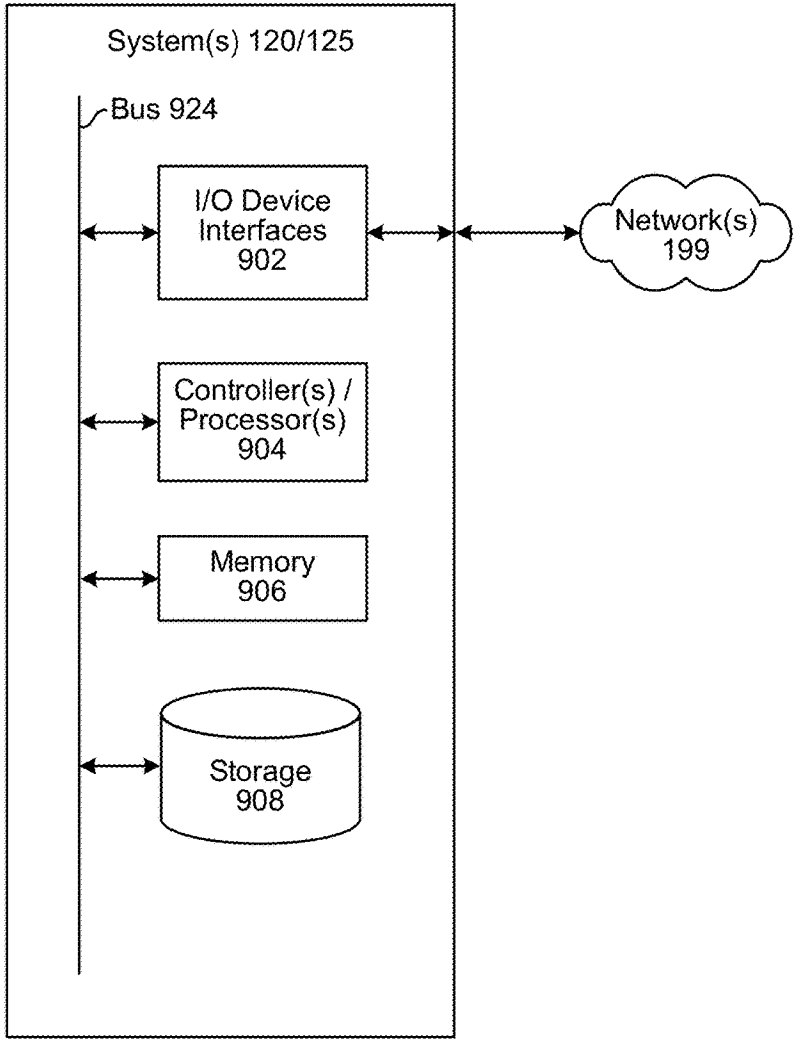
FIG. 9 is a block diagram conceptually illustrating example components of a system, according to embodiments of the present disclosure.

FIG. 8 is a block diagram conceptually illustrating a device 110 that may be used with the system. FIG. 9 is a block diagram conceptually illustrating example components of a remote device, such as the natural language command processing system 120, which may assist with ASR processing, NLU processing, etc., and a skill system 125. A system (120/125) may include one or more servers. A "server" as used herein may refer to a traditional server as understood in a server/client computing structure but may also refer to a number of different computing components that may assist with the operations discussed herein. For example, a server may include one or more physical computing components (such as a rack server) that are connected to other devices/components either physically and/or over a network and is capable of performing computing operations. A server may also include one or more virtual machines that emulates a computer system and is run on one or across multiple devices. A server may also include other combinations of hardware, software, firmware, or the like to perform operations discussed herein. The server(s) may be configured to operate using one or more of a client-server model, a computer bureau model, grid computing techniques, fog computing techniques, mainframe techniques, utility computing techniques, a peer-to-peer model, sandbox techniques, or other computing techniques.

Multiple systems (120/125) may be included in the overall system 100 of the present disclosure, such as one or more natural language processing systems 120 for performing ASR processing, one or more natural language processing systems 120 for performing NLU processing, one or more skill systems 125, etc. In operation, each of these systems may include computer-readable and computer-executable instructions that reside on the respective device (120/125), as will be discussed further below.

Each of these devices (110/120/125) may include one or more controllers/processors (804/904), which may each include a central processing unit (CPU) for processing data and computer-readable instructions, and a memory (806/906) for storing data and instructions of the respective device. The memories (806/906) may individually include volatile random access memory (RAM), non-volatile read only memory (ROM), non-volatile magnetoresistive memory (MRAM), and/or other types of memory. Each device (110/120/125) may also include a data storage component (808/908) for storing data and controller/processor-executable instructions. Each data storage component (808/908) may individually include one or more non-volatile storage types such as magnetic storage, optical storage, solid-state storage, etc. Each device (110/120/125) may also be connected to removable or external non-volatile memory and/or storage (such as a removable memory card, memory key drive, networked storage, etc.) through respective input/output device interfaces (802/902).

Computer instructions for operating each device (110/120/125) and its various components may be executed by the respective device's controller(s)/processor(s) (804/904), using the memory (806/906) as temporary "working" storage at runtime. A device's computer instructions may be stored in a non-transitory manner in non-volatile memory (806/906), storage (808/908), or an external device(s). Alternatively, some or all of the executable instructions may be embedded in hardware or firmware on the respective device in addition to or instead of software.

Each device (110/120/125) includes input/output device interfaces (802/902). A variety of components may be connected through the input/output device interfaces (802/902), as will be discussed further below. Additionally, each device (110/120/125) may include an address/data bus (824/924) for conveying data among components of the respective device. Each component within a device (110/120/125) may also be directly connected to other components in addition to (or instead of) being connected to other components across the bus (824/924).

Referring to FIG. 8, the device 110 may include input/output device interfaces 802 that connect to a variety of components such as an audio output component such as a speaker 812, a wired headset or a wireless headset (not illustrated), or other component capable of outputting audio. The device 110 may also include an audio capture component. The audio capture component may be, for example, a microphone 820 or array of microphones, a wired headset or a wireless headset (not illustrated), etc. If an array of microphones is included, approximate distance to a sound's point of origin may be determined by acoustic localization based on time and amplitude differences between sounds captured by different microphones of the array. The device 110 may additionally include a display 816 for displaying content. The device 110 may further include a camera 818.

Via antenna(s) 822, the input/output device interfaces 802 may connect to one or more networks 199 via a wireless local area network (WLAN) (such as WiFi) radio, Bluetooth, and/or wireless network radio, such as a radio capable of communication with a wireless communication network such as a Long Term Evolution (LTE) network, WiMAX network, 3G network, 4G network, 5G network, etc. A wired connection such as Ethernet may also be supported. Through the network(s) 199, the system may be distributed across a networked environment. The I/O device interface (802/902) may also include communication components that allow data to be exchanged between devices such as different physical servers in a collection of servers or other components.

The components of the device(s) 110, the natural language command processing system 120, or a skill system 125 may include their own dedicated processors, memory, and/or storage. Alternatively, one or more of the components of the device(s) 110, the natural language command processing system 120, or a skill system 125 may utilize the I/O interfaces (802/902), processor(s) (804/904), memory (806/906), and/or storage (808/908) of the device(s) 110, natural language command processing system 120, or the skill system 125, respectively. Thus, the ASR component 650/750 may have its own I/O interface(s), processor(s), memory, and/or storage; the NLU component 660/760 may have its own I/O interface(s), processor(s), memory, and/or storage; and so forth for the various components discussed herein.

As noted above, multiple devices may be employed in a single system. In such a multi-device system, each of the devices may include different components for performing different aspects of the system's processing. The multiple devices may include overlapping components. The components of the device 110, the natural language command processing system 120, and a skill system 125, as described herein, are illustrative, and may be located as a stand-alone device or may be included, in whole or in part, as a component of a larger device or system.

As illustrated in FIG. 10, multiple devices (110*a*-110*p*, 120, 125) may contain components of the system and the devices may be connected over a network(s) 199. The network(s) 199 may include a local or private network or may include a wide network such as the Internet. Devices may be connected to the network(s) 199 through either wired or wireless connections. For example, a speech-detection device 110*a*, a smart phone 110*b*, a smart watch 110*c*, a tablet computer 110*d*, a vehicle 110*e*, a speech-detection device with display 110*f*, a display/smart television 110*g*, a washer/dryer 110*h*, a refrigerator 110*i*, a microwave 110*j*, headphones 110*m*/110*n*, vent-mountable device 110*p* etc. (e.g., a device such as a FireTV stick, Echo Auto or the like) may be connected to the network(s) 199 through a wireless service provider, over a WiFi or cellular network connection, or the like. Other devices are included as network-connected support devices, such as the natural language command processing system 120, the skill system(s) 125, and/or others. The support devices may connect to the network(s) 199 through a wired connection or wireless connection. Networked devices may capture audio using one-or-more built-in or connected microphones or other audio capture devices, with processing performed by ASR components, NLU components, or other components of the same device or another device connected via the network(s) 199, such as the ASR component 750, the NLU component 760, etc. of the natural language command processing system 120.

The concepts disclosed herein may be applied within a number of different devices and computer systems, including, for example, general-purpose computing systems, speech processing systems, and distributed computing environments.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of computers and speech processing should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein. Further, unless expressly stated to the contrary, features/operations/components, etc. from one embodiment discussed herein may be combined with features/operations/components, etc. from another embodiment discussed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk, and/or other media. In addition, components of system may be implemented as in firmware or hardware.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements, and/or steps are in any way required for one or more embodiments or that one or more embodiments necessarily include logic for deciding, with or without other input or prompting, whether these features, elements, and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Disjunctive language such as the phrase "at least one of X, Y, Z," unless specifically stated otherwise, is understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method comprising:

receiving first audio data associated with a first microphone;

receiving second audio data associated with a second microphone;

determining presence of speech using the first audio data and the second audio data;

determining presence of wind using the first audio data and the second audio data by:

determining a complex coherence associated with the first audio data and the second audio data, and determining a phase associated with the complex coherence, wherein determining the presence of wind is based at least in part on the phase, based at least in part on the presence of wind, ceasing speech processing operations which are based on the first audio data and the second audio data;

receiving third audio data from at least one of a third microphone or a fourth microphone positioned on a different side of a device than at least one of the first microphone or the second microphone; and causing speech processing to be performed using the third audio data.

2. The computer-implemented method of claim 1, wherein determining the presence of speech using the first audio data and the second audio data is based at least in part on a derivative of a phase of a complex coherence associated with the first audio data and the second audio data.

3. The computer-implemented method of claim 1, further comprising:

determining a distribution of the phase associated with the complex coherence at an interval from $-\pi$ to $\pi$, wherein determining the presence of wind is based at least in part on the distribution.

4. The computer-implemented method of claim 1, further comprising:

based at least in part on determining the presence of speech, determining first suppressed audio data;

based at least in part on determining the presence of speech, determining second suppressed audio data; and performing speech processing based on the first suppressed audio data and the second suppressed audio data, wherein wind noise associated with the first audio data and the second audio data is suppressed in the first suppressed audio data and the second suppressed audio data.

5. The computer-implemented method of claim 1, further comprising:

based at least in part on determining the presence of wind, determining a cross power spectrum associated with the first audio data and the second audio data;

determining a gain based at least in part on the cross power spectrum; and determining first suppressed audio data and second suppressed audio data based at least in part on the gain.

6. The computer-implemented method of claim 5, further comprising:

performing speech processing based at least in part on the first suppressed audio data and second suppressed audio data wherein wind noise associated with the first audio data and the second audio data is suppressed in the first suppressed audio data and the second suppressed audio data based on the gain.

7. A device comprising:

at least one processor; and memory including instructions operable to be executed by the at least one processor to cause the device to:

receive first audio data associated with a first microphone;

receive second audio data associated with a second microphone;

determine presence of speech using the first audio data and the second audio data; and determine presence of wind using the first audio data and the second audio data by:

determining a complex coherence associated with the first audio data and the second audio data, and determining a phase associated with the complex coherence, wherein determining the presence of wind is based at least in part on the phase, based at least in part on determining the presence of wind, determine a cross power spectrum associated with the first audio data and the second audio data;

determine a gain based at least in part on the cross power spectrum; and determine first suppressed audio data and second suppressed audio data based at least in part on the gain.

8. The device of claim 7, wherein determining the presence of speech corresponding the first audio data and the second audio data is based at least in part on a derivative of a phase of a complex coherence associated with the first audio data and the second audio data.

9. The device of claim 7, wherein the memory further comprises instructions that, when executed by the at least one processor, further cause the device to:

determine a distribution of the phase associated with the complex coherence an interval from $-\pi$ to $\pi$, wherein determining the presence of wind is based at least in part on the distribution.

10. The device of claim 7, wherein the memory further comprises instructions that, when executed by the at least one processor, further cause the device to:

based at least in part on determining the presence of speech, determine the first suppressed audio data;

based at least in part on determining the presence of speech, determine the second suppressed audio data; and perform speech processing based on the first suppressed audio data and the second suppressed audio data, wherein wind noise associated with the first audio data and the second audio data is suppressed in the first suppressed audio data and the second suppressed audio data.

11. The device of claim 7, wherein the memory further comprises instructions that, when executed by the at least one processor, further cause the device to:

based at least in part on the presence of wind, cease speech processing operations which are based on the first audio data and the second audio data;

receive third audio data from at least one of a third microphone or a fourth microphone positioned on a different side of the device than at least one of the first microphone or the second microphone; and cause speech processing to be performed using the third audio data.

12. The device of claim 7, wherein the memory further comprises instructions that, when executed by the at least one processor, further cause the device to:

perform speech processing based at least in part on the first suppressed audio data and the second suppressed audio data wherein wind noise associated with the first audio data and the second audio data is suppressed in the first suppressed audio data and the second suppressed audio data based on the gain.

13. A computer-implemented method comprising:

determining a cross power spectrum based on a first audio signal and a second audio signal;

determining a gain based at least in part on the cross power spectrum;

processing the first audio signal using the gain to determine a first suppressed audio signal;

processing the second audio signal using the gain to determine a second suppressed audio signal;

processing the first suppressed audio signal using a filter to determine a first attenuated audio signal; and processing the second suppressed audio signal using the filter to determine a second attenuated audio signal, wherein the filter reduces incoherence between the first suppressed audio signal and the second suppressed audio signal.

14. The computer-implemented method of claim 13, further comprising:

determining a noise estimate based at least in part on a magnitude-squared cross power spectrum of the first audio signal and the second audio signal.

15. The computer-implemented method of claim 13, wherein determining the first suppressed audio signal and the second suppressed audio signal comprises:

suppressing an incoherent audio signal associated with the first audio signal and the second audio signal; and maintaining a coherent audio signal associated with the first audio signal and the second audio signal.

16. The computer-implemented method of claim 13, wherein determining the first attenuated audio signal and the second attenuated audio signal comprises:

applying a first attenuation to the first suppressed audio signal and the second suppressed audio signal at a first range of frequencies corresponding to wind presence to generate the first attenuated audio signal; and applying a second attenuation to the first suppressed audio signal and the second suppressed audio signal at a second range of frequencies corresponding to speech presence to generate the second attenuated audio signal, wherein the first attenuation is greater than the second attenuation.

17. The computer-implemented method of claim 13, further comprising:

receiving first audio at first microphone, the first audio associated with the first audio signal; and receiving second audio at a second microphone, the second audio associated with the second audio signal, wherein a first device comprises the first microphone and the second microphone and the first device is mounted proximate to at least one of: an air source, or an air flow.

18. The computer-implemented method of claim 13, wherein determining the first suppressed audio signal and the second suppressed audio signal is based at least in part on determining a presence of wind corresponding to wind noise represented in the first audio signal and the second audio signal, and wherein determining the presence of wind comprises:

determining a complex coherence corresponding to the first audio signal and the second audio signal; and determining a phase associated with the complex coherence, wherein determining the presence of wind is based at least in part on the phase.

* * * * *